US006155145A

United States Patent [19]

Oh et al.

[11] Patent Number: 6,155,145

[45] Date of Patent: Dec. 5, 2000

[54] SCREW AND SCREW DRIVING APPARATUS

[76] Inventors: Sae Young Oh; Gene Serk Oh, both of 10210 Sandtrap Ct., Ellicott City, Md. 21042

[21] Appl. No.: 09/311,056

[22] Filed: May 14, 1999

[51] Int. Cl.[7] ..... B25B 23/08

[52] U.S. Cl. ..... 81/451; 81/125

[58] Field of Search ..... 81/451, 54, 55, 81/57.37, 125, 429

[56] References Cited

U.S. PATENT DOCUMENTS

| | | | |
|---|---|---|---|
| 2,327,074 | 8/1943 | Snyder | 81/451 |
| 3,901,298 | 8/1975 | Eby | 81/125 |
| 4,237,946 | 12/1980 | Leitner | 81/429 |
| 4,945,789 | 8/1990 | Martinengo | 81/55 |
| 5,341,708 | 8/1994 | Nick | 81/451 |
| 5,509,330 | 4/1996 | Nick | 81/55 |
| 5,557,990 | 9/1996 | Shin | 81/54 |
| 5,996,452 | 12/1999 | Chiang | 81/429 |

FOREIGN PATENT DOCUMENTS

| | | | |
|---|---|---|---|
| 06277961 | 10/1994 | Japan | 81/54 |
| 225620 | 12/1924 | United Kingdom | 81/451 |
| 2177333 | 1/1987 | United Kingdom | 81/451 |

*Primary Examiner*—Stephen F. Gerrity
*Assistant Examiner*—David B. Thomas
*Attorney, Agent, or Firm*—Jacobson, Price, Holman & Stern, PLLC

[57] ABSTRACT

The system generally comprises a nail that engages an assembled screw driving apparatus. The apparatus is typically stored in a ready position and moved to the load position in order to affix the nail to the apparatus. In the ready position, a top section of the bit extends beyond the end of the cylinder. The nail can now be easily fitted with the top section of the screw bit. The nail is fitted with the screw bit, and depressed into the apparatus. The apparatus automatically enters a drill position, in which the nail is locked to the apparatus and drilling begins. The nail will be released from the apparatus at a certain distance from the substrate. The nail is further rotated to drill the nail to a predetermined depth in the substrate. Once screwing is complete, the apparatus is removed from the nail and the apparatus automatically returns to the ready position.

16 Claims, 18 Drawing Sheets

27b

SCREW AND SCREW DRIVING APPARATUS

BACKGROUND OF THE INVENTION

1. Field of the Invention

The present invention relates to a screw and screw driving apparatus. More particularly, the present invention relates to screws and screw drivers, and especially screws that are used with common carpentry and building materials, including wood and plywood.

2. Description of the Related Art

Screws or screw nails have a spiral structure in order to allow clockwise drilling of the nail. By drilling the screw nail counterclockwise, the nail will retreat backward from a target area. Screw nails generally are better able to grip materials than regular nails. To use these screws, however, you must find an appropriate drill or screw bit and set it onto a drill. One hand is required to hold the screw bit and the nail together, while the other hand is used to grip the drill. The screw is then aligned with the target area.

During nailing, the nail must be forced into the target in a substantially vertical manner. Therefore, the drill must be forced into the target, while at the same time the nail head and the screw bit's tip are held in direct contact during drilling. When the nail head is evenly level with the surface of the target area, the drilling is stopped and the nailing is complete. Otherwise, the nail head will dig into the target.

If pressure is not applied to the bit and nail, the nail head may fall out of alignment with the bit tip. This will cause grinding of the nail head and the bit tip. In addition, if the nail does not completely screw into the target, the nail must be displaced from the target area. In addition to the wasted nail, the screw bit may be ground, and may also require replacement.

Certain projects may require the nail to be placed at a high level, such as at or above shoulder level. These projects require great strength to force the nail into the target at the high level. Additional strength is required when the target is in an area displaced to the right or left of the user's body. Strong force is further required in order to keep the screw bit and the nail in direct contact with one another as the nail is rotated. The operator must also be careful to keep the screw bit perpendicular to and aligned with the nail screw. Otherwise, the screw bit may fall off of the nail during this screwing process.

Due to these disadvantages, when working with drilling nails, the operator must elevate and/or adjust position in a way that the target area is substantially directly in front of the operator's chest.

SUMMARY OF THE INVENTION

In view of the foregoing, it is a primary object of the present invention to provide a nail and driver that are easy to use. It is another object of the invention to hold the nail and screw bit together tightly as one piece during drilling. It is yet another object of the present invention to release the nail when nailing is completed. It is another object to substantially reduce the amount of manual force required during drilling and to provide a drilling process that is self-functional.

Another object of the invention is to save time as well as increase safety while nailing, and especially when nailing at elevated levels. It is another object to automatically stop nailing as soon as the nail is at a point in which the nail is flatly placed within the surface. This eliminates the need for the operator to approximate when drilling should stop, which in turn prevents over-drilling.

The system generally comprises a nail (FIGS. 1–2) that engages a screw driving apparatus (FIGS. 14–15). The apparatus essentially has the following components: screw bit (FIGS. 3–4); drive shaft (FIG. 5); first and second stage coupling devices (FIGS. 6 and 7, respectively); primary and secondary cylinders (FIGS. 8 and 9, respectively); leading and rear sleeves (FIGS. 10 and 11, respectively) ; leading and rear outer locking collars (FIGS. 12 and 13(*a*)–13(*b*), respectively); washer (FIG. 13(*c*)); and, inner and outer springs.

The apparatus is typically stored in the ready position and moved to the load position in order to affix the nail to the apparatus. In the ready position, a top section of the bit extends beyond the end of the cylinder. The nail can now be easily fitted with the top section of the screw bit. The nail is fitted with the screw bit, and depressed until the head of the nail passes the upper leading balls.

Once the nail is placed on the apparatus, the apparatus is moved to the drill position, in which the nail is locked to the apparatus. In this position, the nail may be screwed to a substance. At a certain distance from the head of the nail to the surface of the substrate, the nail is released from the apparatus, the release position. The nail is further rotated in the windup position to drill the nail to the a predetermined depth in the substrate. Once screwing is complete, the apparatus is removed from the nail. The apparatus automatically returns to the ready position.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 7(*c*) is a cut-away perspective view showing the second stage coupling device of FIGS. 7(*a*) and 7(*b*) with a different spacing between the plug and the adjustment ring.

FIG. 13(*c*) is a cut-away perspective view of the washer shown in FIG. 13(*a*).

DETAILED DESCRIPTION OF THE PREFERRED EMBODIMENTS

Figure 1A:
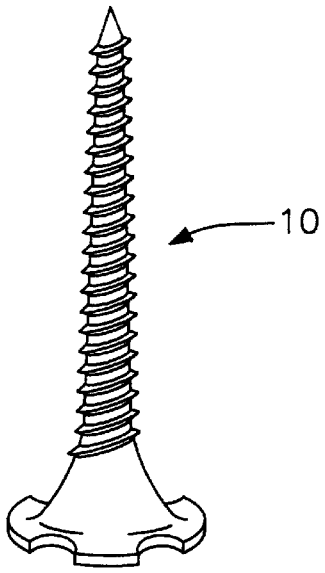
FIGS. 1(*a*), 1(*b*) and 1(*c*) are bottom perspective, top, and top perspective views, respectively, of a nail used in a preferred embodiment of the invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 13A:
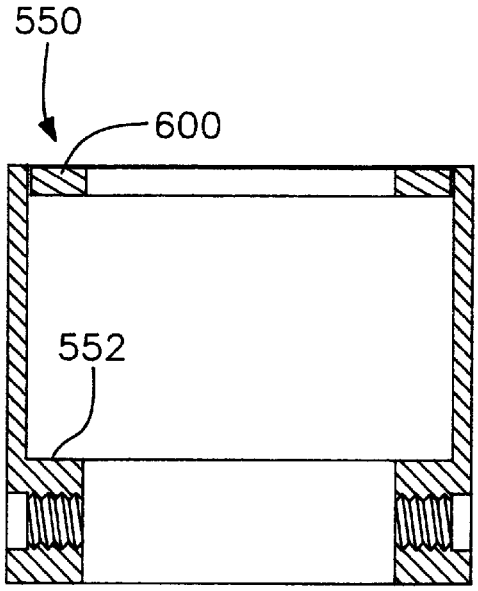
FIGS. 13(*a*) and 13(*b*) are cross-sectional side and cut-away perspective views, respectively, of a rear retaining collar and washer used in the apparatus of the present invention.
Figure 13B:
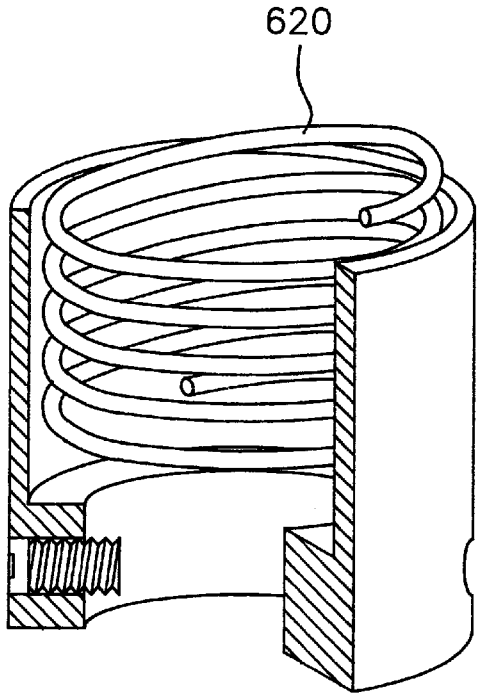
Figure 13C:
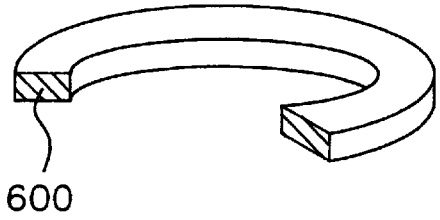
Figure 14:
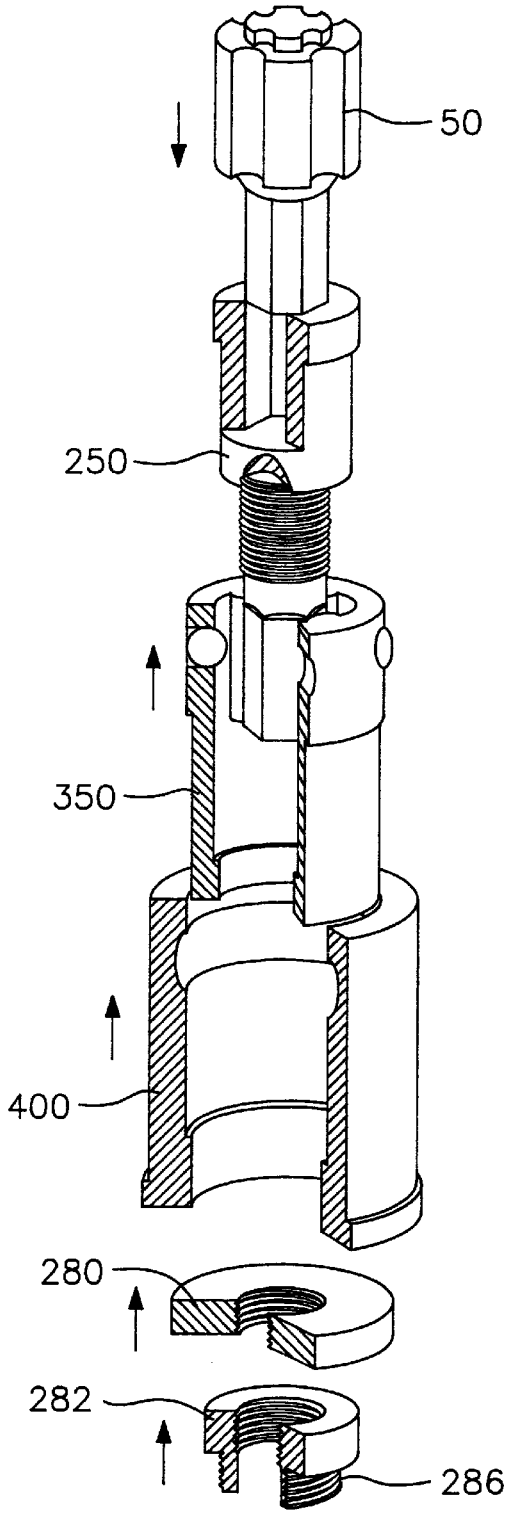
FIG. 14 is a partially exploded cut-away perspective view of the apparatus in accordance with a preferred embodiment of the present invention and displays assembly of the device.
Figure 15:
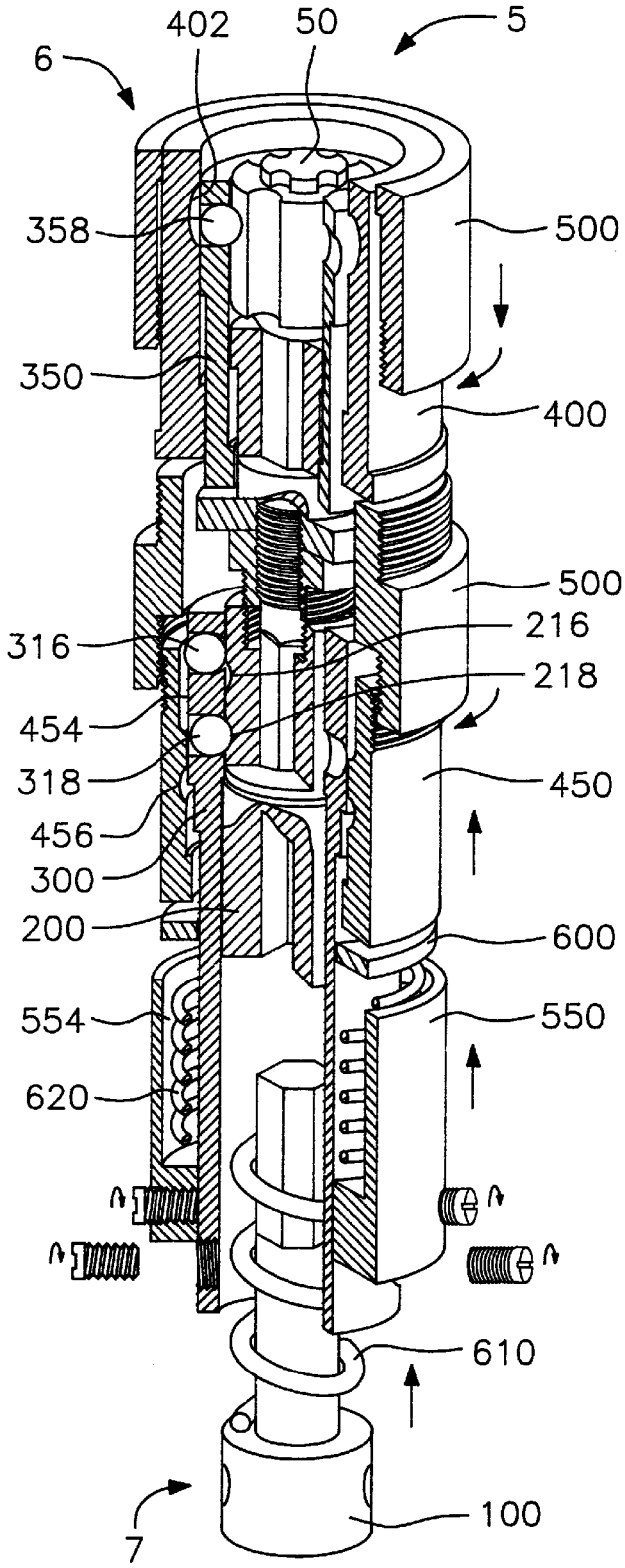
FIG. 15 is an exploded cut-away perspective view of the apparatus in accordance with the present invention and displays the assembly of the device.

Turning to the drawings, the system generally comprises a nail 10 (FIGS. 1–2) that engages a screw driving apparatus 5 (FIGS. 14–15). As best shown in FIGS. 14–15, the screw driving apparatus 5 has a top or bit portion (leading end) 6 and a bottom or driving portion (rear end) 7. The apparatus 5 essentially has the following components: bit 50 (FIGS. 3–4); drive shaft 100 (FIG. 5); first and second stage coupling devices 200, 250 (FIGS. 6 and 7, respectively); primary and secondary cylinders 300, 350 (FIGS. 8 and 9, respectively); leading and rear sleeves 400, 450 (FIGS. 10 and 11, respectively); leading and rear outer locking collars 500, 550 (FIGS. 12 and 13(*a*)–13(*b*), respectively); washer 600 (FIG. 13(*c*)); and, inner and outer springs 610, 620.

The drive shaft 100 and the first and second stage couplers 200, 250 form the core components of the screw driving apparatus 5. An outer shell is generally formed by the primary and secondary cylinders 300, 350, leading and rear sleeves 400, 450, and leading and rear locking collars 500, 550. The core components are generally slidably received within the outer shell.

Figure 1B:
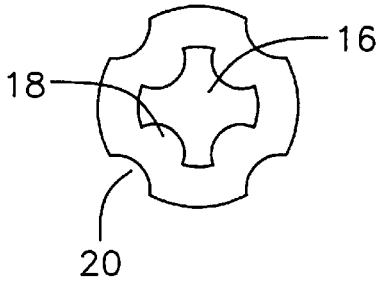
Figure 1C:
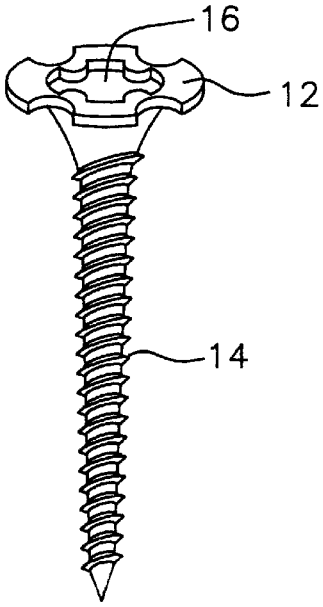

FIGS. 1(*a*)–1(*c*) show a preferred nail screw 10. The nail 10 has a head 12 and elongated shank 14. A central cavity 16 is located in the top of the head 12 defining four projections or male fittings 18. The male fittings 18 face inwardly within cavity 16. In addition, recesses 20 are located about the outer circumference of the head 12. The recesses are aligned with projections 18.

Figure 2A:
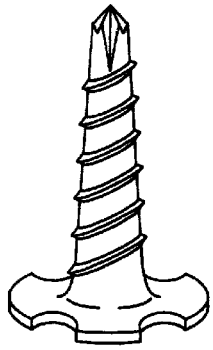
FIGS. 2(*a*), 2(*b*) and 2(*c*) are bottom perspective, top, and top perspective views, respectively, of a nail having a conventional head.
Figure 2B:
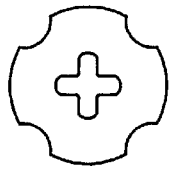
Figure 2C:
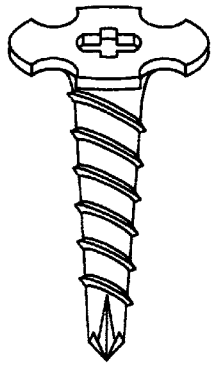

As shown in the embodiment of FIG. 1, the projections 18 and recesses 20 preferably have a rounded shape. However, as shown in FIGS. 2(*a*)–2(*c*), the cavity 16 may conform to a conventional philip-head screw. The nails 10 have a very shallow cavity, approximately 1 mm, so that it is easy to cover up with paint or compound, if necessary. The nail 10 will also not create a shadow when installed. In addition, the nails 10 may have different colors to better match the target. However, any standard nail may be used.

Figure 3A:
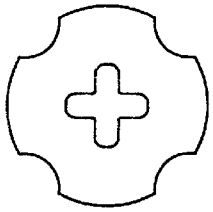
FIGS. 3(*a*), 3(*b*) and 3(*c*) are top, side and perspective views, respectively, of a screw bit used with the nail of FIG. 2.
Figure 3B:
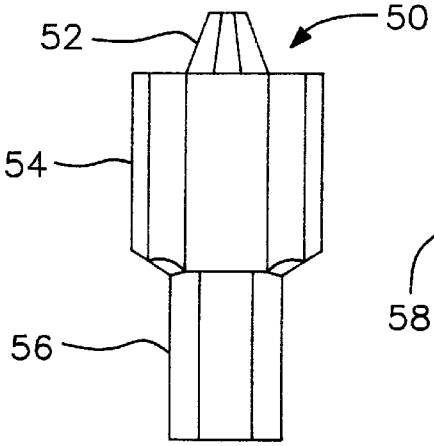
Figure 3C:
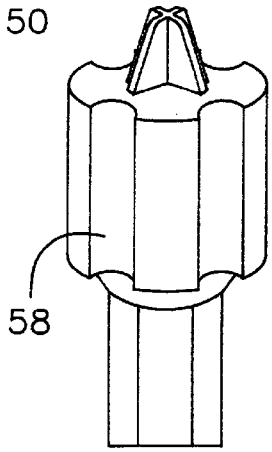

Turning next to FIGS. 3(*a*)–3(*c*) and 4(*a*)-4(*c*), screw bits 50 are shown for use with the nails 10 of FIGS. 2 and 1, respectively. The screw bits 50 have a top section 52, middle section 54 and bottom section 56. The middle section 54 is the widest part of the screw bit 50, and the top section 52 is centrally located at the top surface of the middle section 54. Four grooves 58 are located about the middle section 54, and are preferably aligned with notches 60 (FIG. 4(*a*)) of the top section 52. The grooves 58 extend the entire length of the middle section 54. These grooves align with ridges 362 (FIG. 9), so that the screw bit 50 is slidable within the secondary cylinder. The bottom section 56 preferably has a hexagonal cross-section.

Figure 4A:
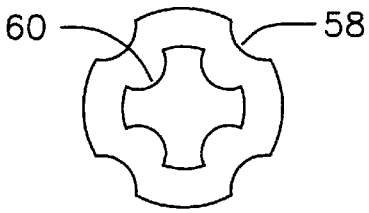
FIGS. 4(*a*), 4(*b*) and 4(*c*) are top, side and perspective views, respectively, of a screw bit used with the nail of FIG. 1.
Figure 4B:
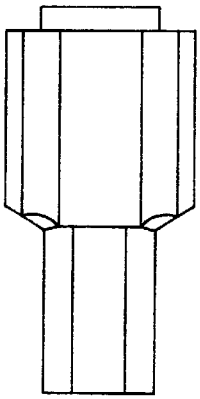
Figure 4C:
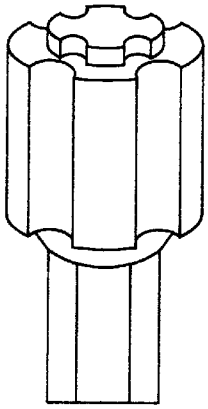

FIGS. 4(*a*)–4(*c*) show the preferred bit 50 of the invention as having a top section 52 that is flat and forming four notches or female fittings 60. The notches 60 are located evenly about the top section 52 of the bit 50 and mate with the male fittings 18 of nail 10. FIGS. 3(*a*)–3(*c*) show a regular philip screw head fitted at the top section 52 of bit 50. Thus, any suitable top section 52 may be used with the invention.

Figure 5A:
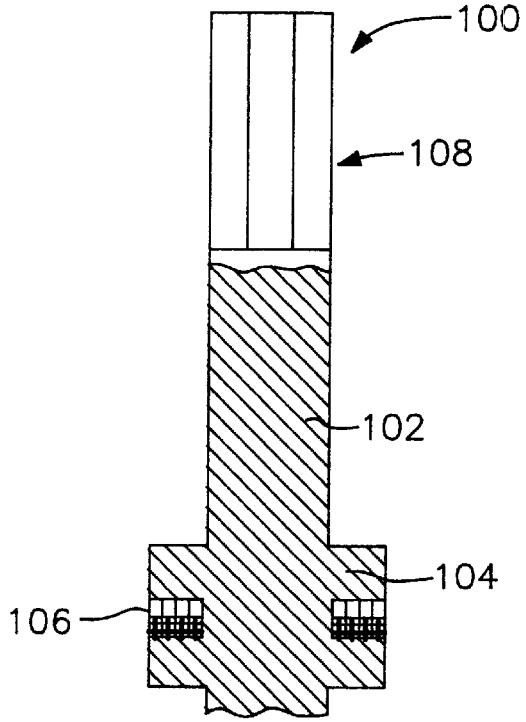
FIGS. 5(*a*) and 5(*b*) are side and perspective views, respectively, of a drive shaft used in the apparatus of the present invention.
Figure 5B:
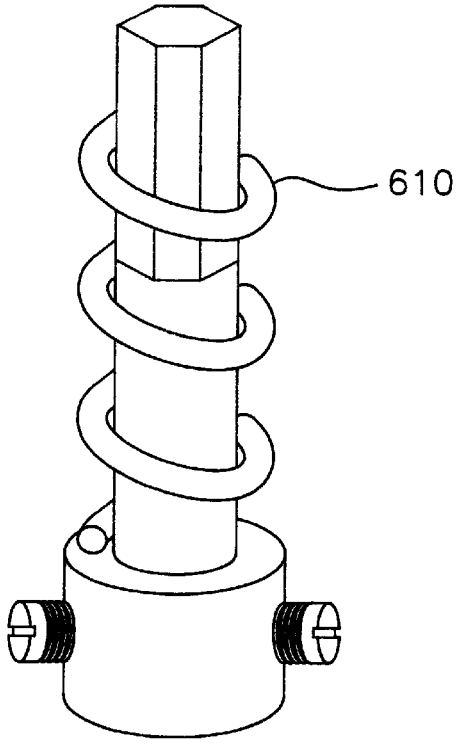

Turning to FIGS. 5(*a*)–5(*b*), the drive shaft 100 forms an elongated rod 102. The bottom end of the drive shaft 100 forms a handle, or alternatively may connect to an electric drill or like device (not shown). The leading end portion 108 of the rod 102 has a hexagonal cross-section. A ring 104 is integral with rod 102. The ring 104 has a threaded opening 106 that receives a bolt or other fastener. The fastener passes through an opening in the main cylinder 300 and into the opening 106 of ring 104 to thereby lock the drive shaft 100 to main cylinder 300. As shown in FIG. 5(*b*), inner spring 610 is placed over the top portion of the rod 102 and rests on a top surface of ring 104.

Figure 6A:
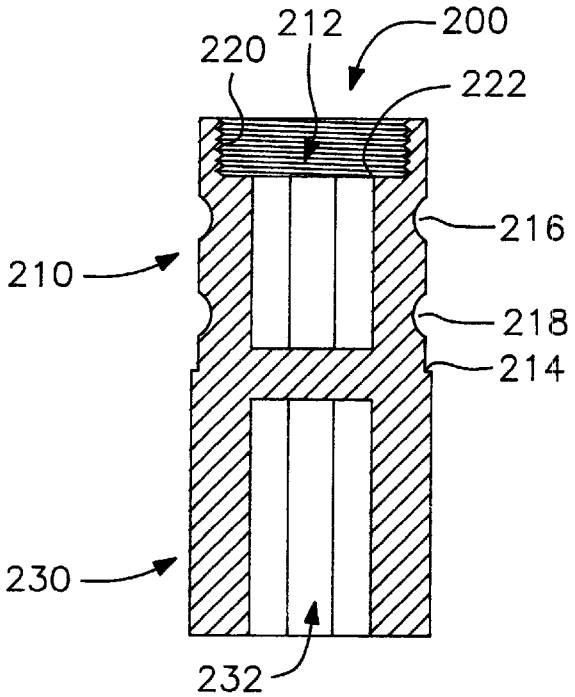
FIGS. 6(*a*) and 6(*b*) are cross-sectional side and a cut-away perspective views, respectively, of a first stage coupling device used in the apparatus of the present invention.
Figure 6B:
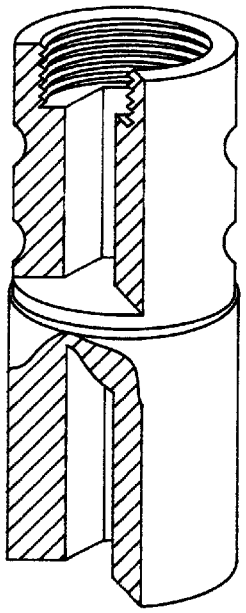

The leading portion 108 of the drive shaft 100 is slidably received by the first stage coupling device 200. Referring to FIGS. 6(*a*) and 6(*b*), the first stage 200 is a circular member having a leading and rear end 210, 230. The leading end 210 has an outer diameter that is slightly smaller than that of the rear end 230. Accordingly, a lip 214 is formed that divides the leading end 210 from the rear end 230.

Four leading and rear indents 216, 218, are located on the outer surface of the leading end 210 of the first stage coupler 200. The indents 216, 218 may alternatively comprise channels that extend circumferentially about the entire outer surface of the leading end 210.

The leading and rear ends 210, 230 of the first stage 200 each have respective central bores 212, 232. The leading bore 212 is shown facing the leading end or bit portion 6 of apparatus 5, which is upward in the figures. The rear bore 232 faces the rear end 7 of apparatus 5, or downward in the figures. Each of the leading and rear bores 212, 232, have a hexagonal shape. A threaded portion 220 is located at the opening of the leading bore 212. The threaded portion 220 is wider than the bore, thereby forming ledge 222.

The rear bore 232 slidably receives the hexagonal leading end portion 108 of drive shaft 100. Since both the rear bore 232 and leading portion 108 of the drive shaft 100 are hexagonal, rotational movement is prevented. Thus, the drive shaft 100 will turn the first stage coupling device 200. The drive shaft 100 readily slides in and out of the rear bore 232.

Figure 7A:
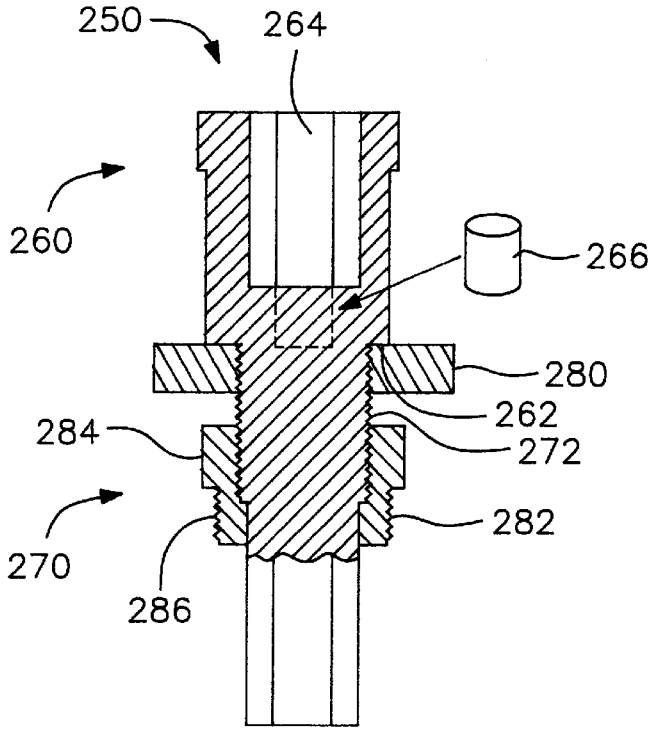
FIGS. 7(*a*) and 7(*b*) are cross-sectional side and a cut-away perspective views, respectively, of a second stage coupling device used in the apparatus of the present invention.
Figure 7B:
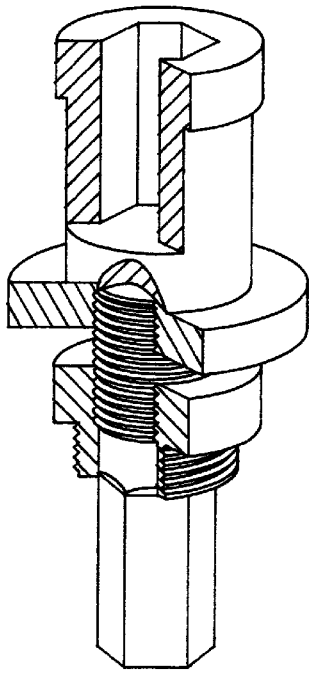
Figure 7C:
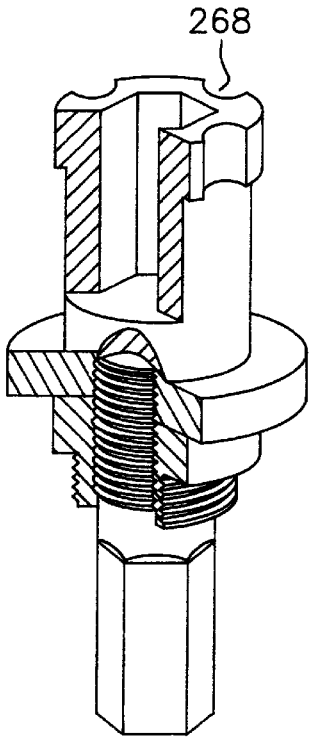

A second stage coupling device 250 is shown in FIGS. 7(*a*)–7(*c*). The second stage coupling device 250 slidably engages the first stage coupling device 200. The second stage 250 has an leading end 260 forming a female receptacle and a rear end 270 forming a male receptacle. The leading end 260 is wider than the rear end 270, forming a ledge 262 therebetween.

The rear end 270 is generally formed as a rod. The top of the rod has threads 272 at one end and a hexagonal cross section at the opposite end, the two ends separated by a mid-section. A threaded ring 280 is screwed onto threads 272, and may be screwed up until the ring 280 contacts ledge 262. The ring 280 is substantially wider than the second stage coupling device 250. In addition, an adjustment plug 282 is mounted to the bottom portion of the threads 272. The plug 282 has a head 284 and a neck 286 with external threads. The neck 286 is narrower than the head 284 to form a lip therebetween.

The hexagonal portion of the male receptacle 270 is slidably received in the hexagonal leading bore 212 of the first stage coupling device 200. The male end 270 of the second stage coupler 250 is fully inserted into the leading bore 212 until the external threads of the plug neck 286 are able to engage the internal threads 220 of the first stage 200. Since the bore 212 and male end 270 are hexagonal, the first stage 200 cannot rotate with respect to the second stage 250. Thus, the plug 282 must be rotated in order to screw the plug 282 to threads 220 of the first stage 200, thereby engaging the first and second stages 200, 250.

The adjustment plug 282 and threads 220 of bore 212 cooperate to define a combined length of the first and second stages 200, 250. As shown in FIG. 7(*b*), the plug 282 may be adjusted so that there is a gap between ring 280 and the plug 282. Likewise, as shown in FIG. 7(*c*), the plug 282 may be adjusted so that substantially no gap is between the plug 282 and ring 280. The exterior threads 286 of the plug 282, as well as the interior threads 220 of the first stage 200, may be reversed so that rotation of the plug 282 will simultaneously advance the plug 282 away from ring 280 and tighten plug 282 with threads 220.

The leading end or female receptacle 260 of the second stage coupling device 250 has a central bore 264 with a hexagonal shape. A cylindrical magnet 266 is preferably placed within a small hole located in the base of the bore 264. The magnet 266 may be affixed in the hole by glue, or may be hammer in the hole. Bore 264 receives the hexagonal bottom end 56 of the screw bit 50. The magnet 266 prevents the screw bit 50 from falling out of the bore 264, but allows the screw bit 50 to be removed by an operator as desired.

FIG. 7(*c*) also shows optional recesses 268 located in the head of the coupler 250. The recesses 268 align with ridges 362 in the secondary cylinder 350 (FIG. 9) to make assembly easier. The recesses 268 further ensure rotation of coupler 250 with secondary cylinder 250.

Figure 8A:
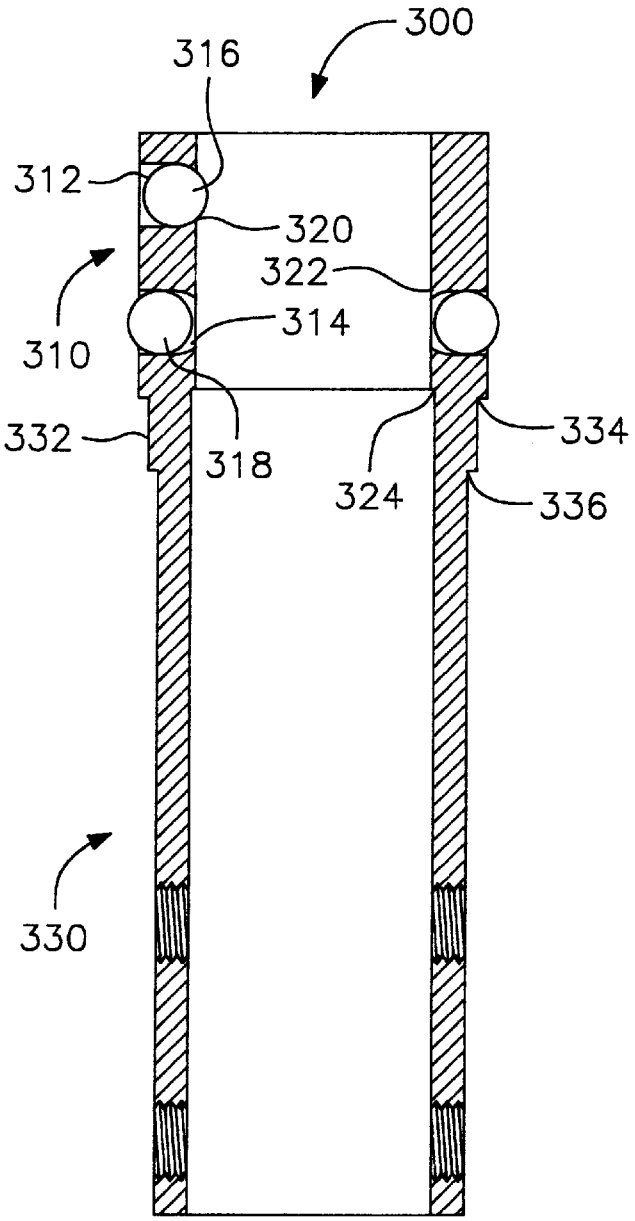
FIGS. 8(*a*) and 8(*b*) are cross-sectional side and cut-away perspective views, respectively, of a primary cylinder used in the apparatus of the present invention.
Figure 8B:
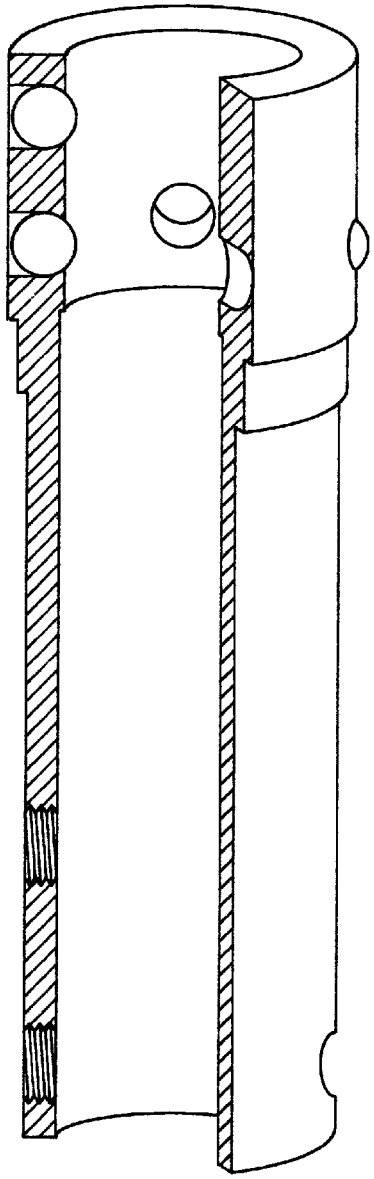

FIGS. 8(*a*) and 8(*b*) show the primary cylinder 300. When the driver 5 is assembled (FIG. 15), cylinder 300 receives the drive shaft 100, first stage coupler 200 and at least a part of the male receptacle 270 of the second stage coupler 250. Cylinder 300 has a head section 310 and a tapered body 330. A step 332 is located at the top or leading end of the body 330. The step 332 defines external upper and lower lips 334, 336. Openings are positioned at the rear end of the body 330 for engaging a bolt or other fastener.

Head section 310 contains at least one upper through-hole 312 and four lower through-holes 314 that each receive an upper and lower ball 316, 318, respectively. A retaining lip 320, 322 is located at the interior side of each hole 312, 314. The retaining lip 320, 322 curves inward to form a narrow portion with respect to the through-hole 312, 314. Thus, the retaining lip 320, 322 prevents the respective ball 316, 318 from falling to the interior of cylinder 300.

Additionally, an internal lip 324 is located at the rear end of head 310. Internal lip 324 is offset slightly from the external upper lip 324. However, the internal lip 324 may also be configured to align with the external leading lip 334.

Figure 9A:
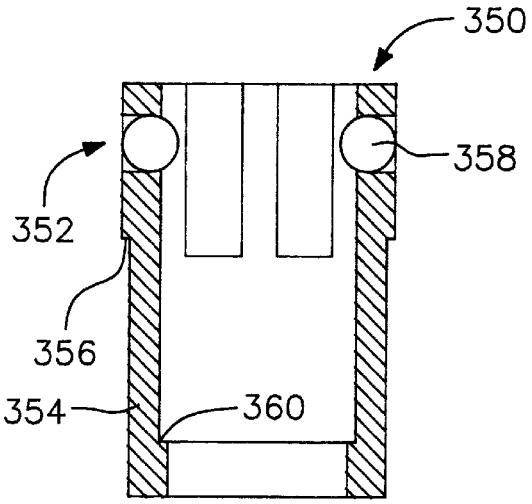
FIGS. 9(*a*), 9(*b*) and 9(*c*) are cross-sectional side, top, and cut-away perspective views, respectively, of a secondary cylinder used in the apparatus of the present invention.
Figure 9C:
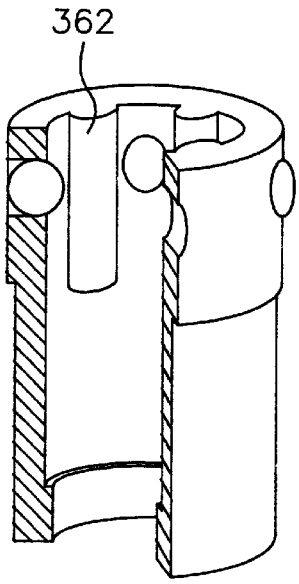
Figure 9B:
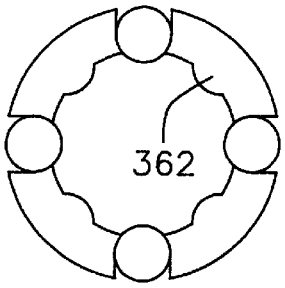

Referring to FIGS. 9(*a*) and 9(*b*), the secondary cylinder 350 is shown. When the screw driver 5 is assembled (FIG. 15), the secondary cylinder 350 receives the leading end 260 of the secondary stage coupling device 250, as well as screw bit 50.

The secondary cylinder 350 has a head portion 352 and a body 354 separated by lip 356. The head portion 352 has through-holes with a tapering lip. A ball 358 is positioned in the through-hole, and the lip prevents the ball 358 from falling into the internal passage of the secondary cylinder 350. The secondary cylinder 350 further has an internal lip 360 located toward the rear end of the body portion 354.

Figure 29:
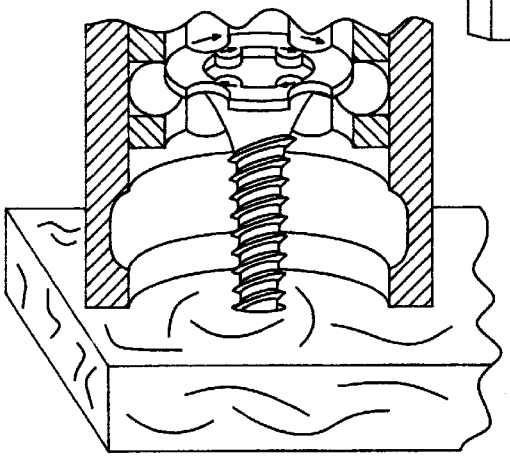
FIGS. 27*a*, 27*b*, 28 and 29 are cut-away perspective views of the detached embodiment of the invention in a windup position.

As best shown in FIG. 9(*c*), four ridges 362 project inward from the inner surface of the secondary cylinder 350. The ridges 362 are preferably circular and are flush with the top surface of the cylinder 350. Preferably, the ridges 362 extend downward to just below the exterior lip 356. In operation, the ridges 362 align with the grooves 58 of the screw bit 50. In this manner, the screw bit 50 is prevented from rotating within cylinder 350. In addition, the ridges 362 align with recess 20 on the outer periphery of the nail 10. Thus, the ridges 362 are also used to rotate screw bit 50 and nail 10, as shown in FIG. 29.

Figure 10A:
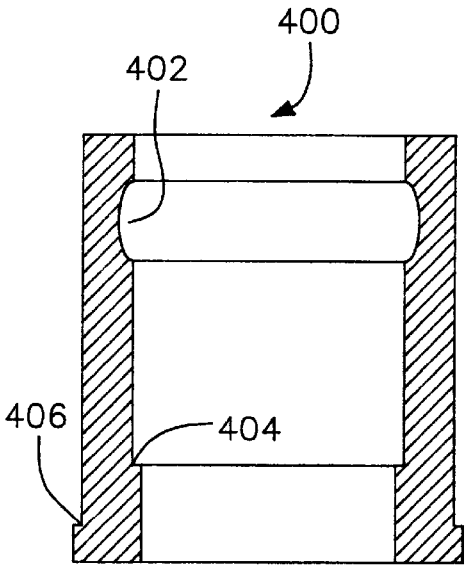
FIGS. 10(*a*) and 10(*b*) are cross-sectional side and perspective views, respectively, of a leading sleeve used in the apparatus of the present invention.
Figure 10B:
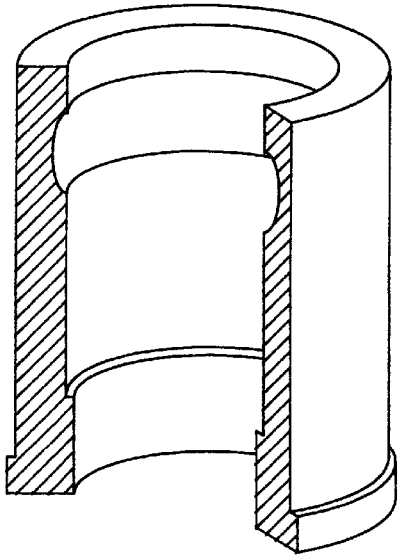

Upper sleeve 400 operates about the secondary cylinder 350. The upper sleeve 400 is best shown in FIGS. 10(*a*) and 10(*b*). The upper sleeve 400 has a relatively wide trench 402 about its leading end. The trench 402 extends the entire inner circumference of the sleeve 400. The leading sleeve 400 also has an internal lip 404 located toward the rear end of the sleeve 400, and an external lip 406 further toward the rear end of the sleeve 400.

Figure 11A:
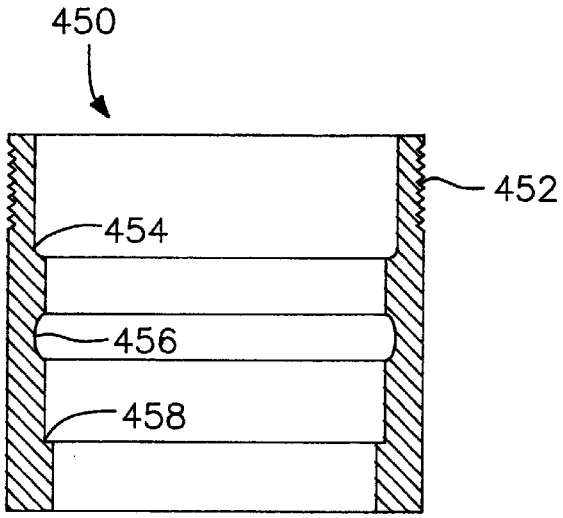
FIGS. 11(*a*) and 11(*b*) are cross-sectional side and cut-away perspective views, respectively, of a rear or lower sleeve used in the apparatus of the present invention.
Figure 11B:
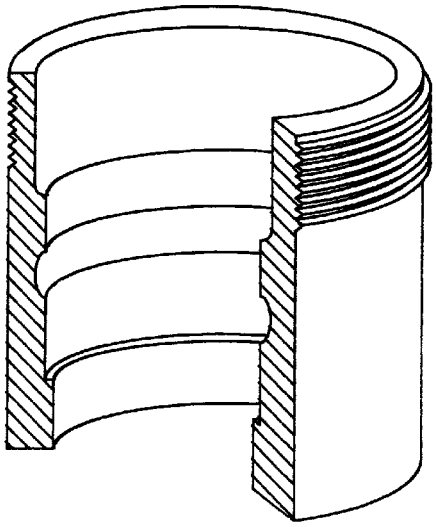

A lower or rear sleeve 450 operates about the leading end of the main cylinder 300. The lower sleeve 450 is shown in FIGS. 11(*a*) and 11(*b*). The rear sleeve 450 has threads 452 about the exterior of its leading end and a gutter 454 located at the inside of the leading end. In addition, a channel 456 is located at about the middle of the rear sleeve 450, and a lip 458 is located near the rear end of the rear sleeve 450. The gutter 454, channel 456 and lip 458 each extend the entire circumference of the rear sleeve 450.

Figure 12A:
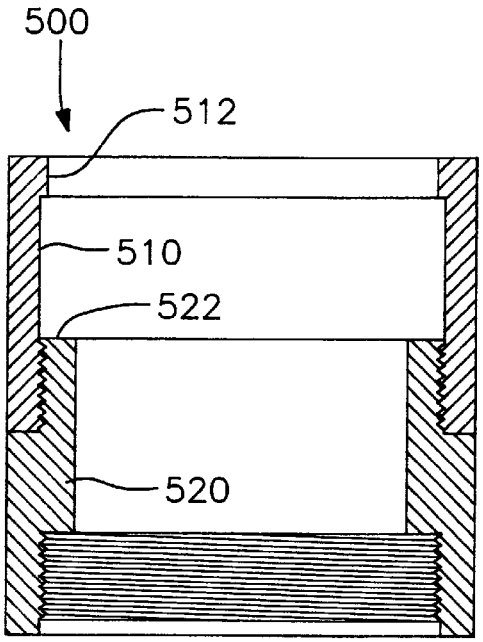
FIGS. 12(*a*) and 12(*b*) are cross-sectional side and cut-away perspective views, respectively, of a leading locking collar used in the apparatus of the present invention.
Figure 12B:
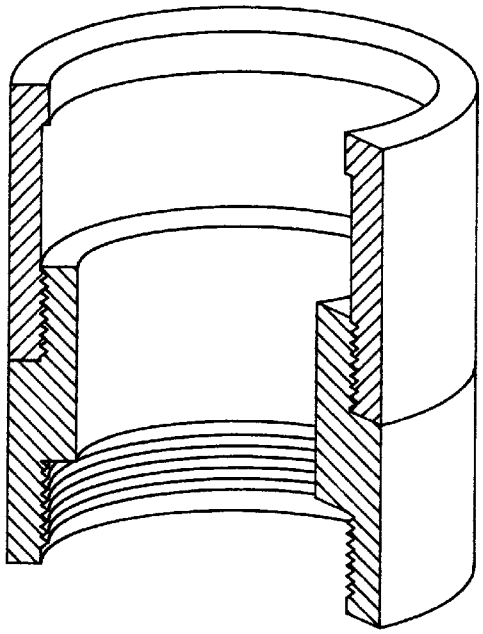

A leading locking collar 500 is shown in FIGS. 12(*a*) and 12(*b*). The leading locking collar 500 is positioned about the leading sleeve and 400 screwed together with the rear sleeve 450. In accordance with the preferred embodiment, the leading locking collar 500 is comprised of upper and lower members 510, 520. The upper member 510 has a head 512 at the leading end. The rear end of the upper member 510 has internal threads.

The lower member 520 of the leading locking collar 500 has a tapered top end with external threads. The external threads of the lower member 520 engage the threaded portion of the upper member 510. The top surface 522 of the lower member 520 forms a ledge. The rear end of the leading locking collar 500 further has internal threads which mate with the external threaded portion 452 of the lower sleeve 450.

A rear outer locking or retaining collar 550 is positioned about the rear end of the primary cylinder 300. As shown in FIGS. 13(*a*) and 13(*b*), the retaining collar 550 has a rear end that is formed with a ledge 552 to form a space or chamber 554 (FIG. 15) between the collar 550 and the primary cylinder 300. Two openings are located in the lower end of the retaining collar 550 to receive a bolt or other fastener. The bolt or fastener passes through collar 550 and into an opening in the primary cylinder 300 to lock the collar 550 to cylinder 300.

An outer spring 620 is located within the chamber 554. A washer 600 is positioned at the top of the chamber 554 to prevent the spring 620 from escaping the chamber 554. The spring 620 is compressed between the ledge 552 of the collar 550 and the washer 600. The washer 600 fits between the primary cylinder 300 and the collar 550 and is capable of sliding up and down on the cylinder 300 to compress and release the outer spring 620.

Turning to FIGS. 14 and 15, the preferred method of assembling the apparatus 5 will now be discussed. As shown in FIG. 14, the bit 50 is placed inside the secondary stage coupler 250. Ring 280 and plug 282 are placed at the other end of the secondary stage coupler 250. This combined unit is placed within the secondary cylinder 350, which is then placed inside upper sleeve 400.

In FIG. 15, the assembled unit of FIG. 14 is engaged with the first stage coupler 200. The first stage coupler 200 is placed within the leading end of the primary cylinder 300. The drive shaft 100, with spring 610, is placed within the main cylinder 300 at its rear end until drive shaft 100 engages with the first stage coupler. The leading locking collar 500 and rear sleeve 450 are positioned and engaged. Washer 600 is placed over the main cylinder 300 and the rear retaining collar 550, together with outer spring 620, is engaged to the cylinder 300. During assembly, a magnet or other holding means may be used to prevent balls 358, 316, 318 for falling out of position.

Figure 16A:
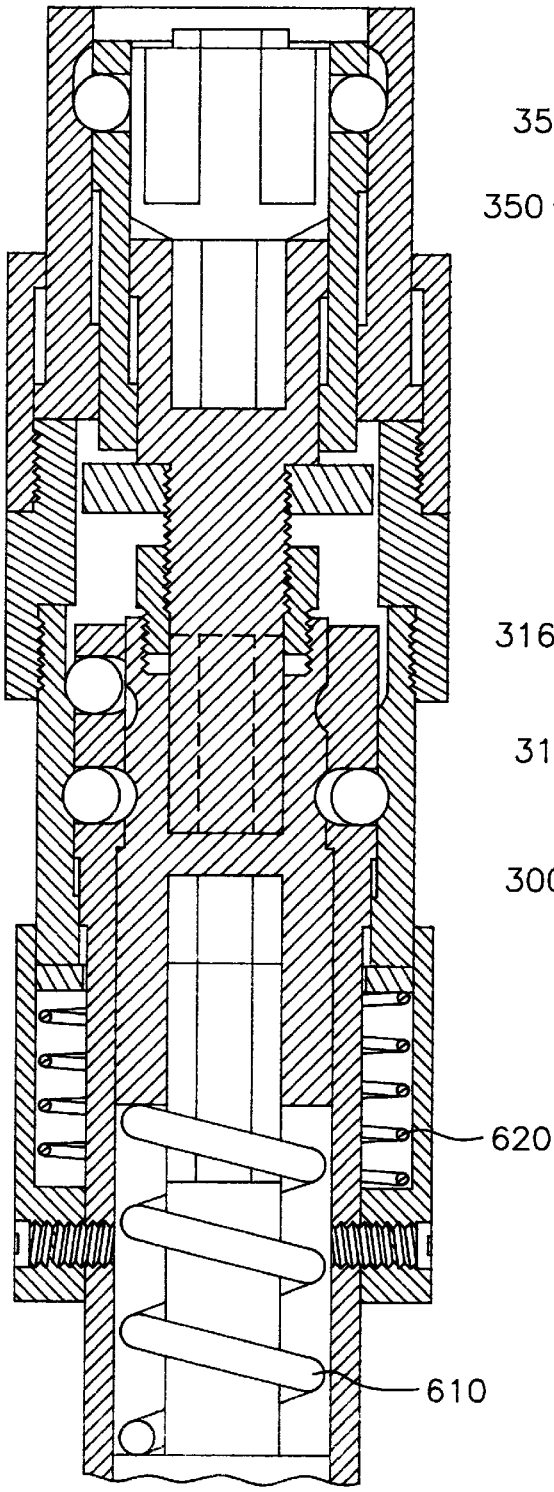
FIGS. 16(*a*) and 16(*b*) are cross sectional side and cut-away perspective views, respectively, of the apparatus in a ready position.
Figure 16B:
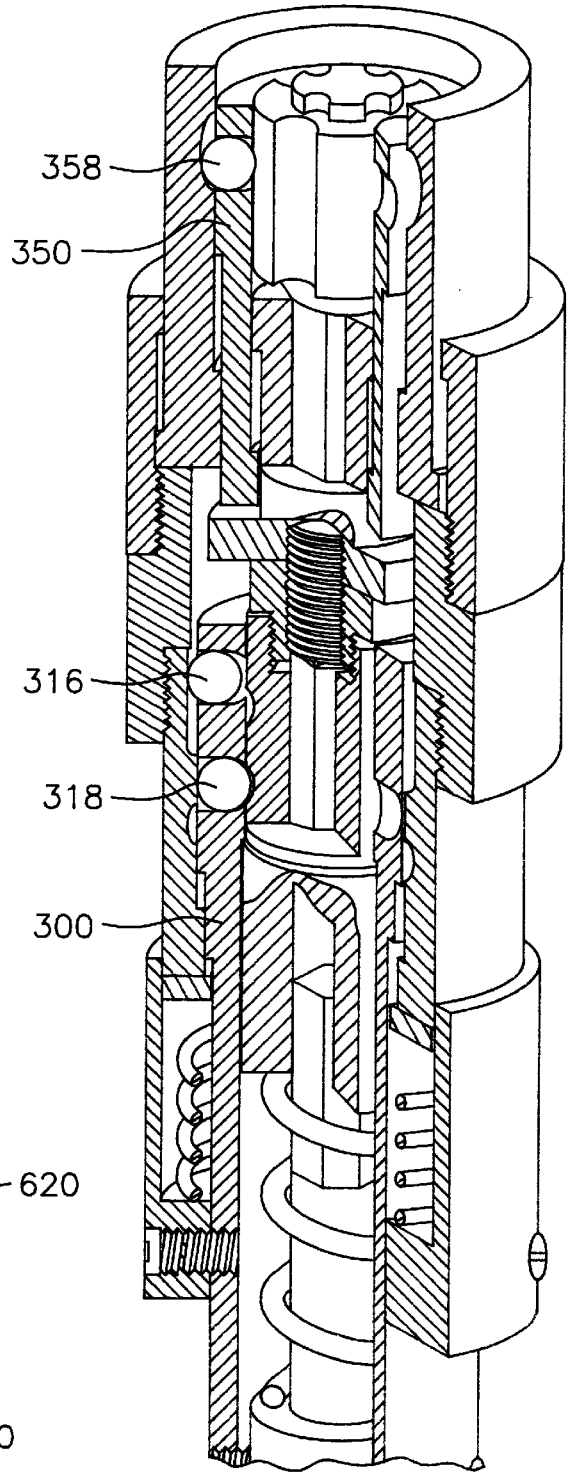
Figure 17A:
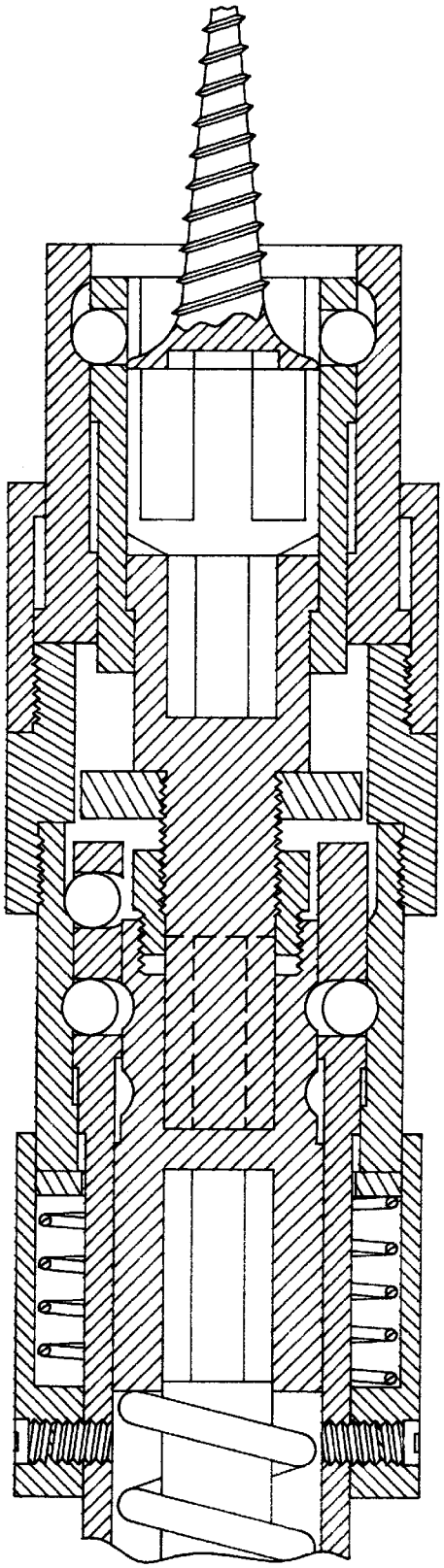
FIGS. 17(*a*) and 17(*b*) are cross sectional side and cut-away perspective views, respectively, of the apparatus in a loaded position.
Figure 17B:
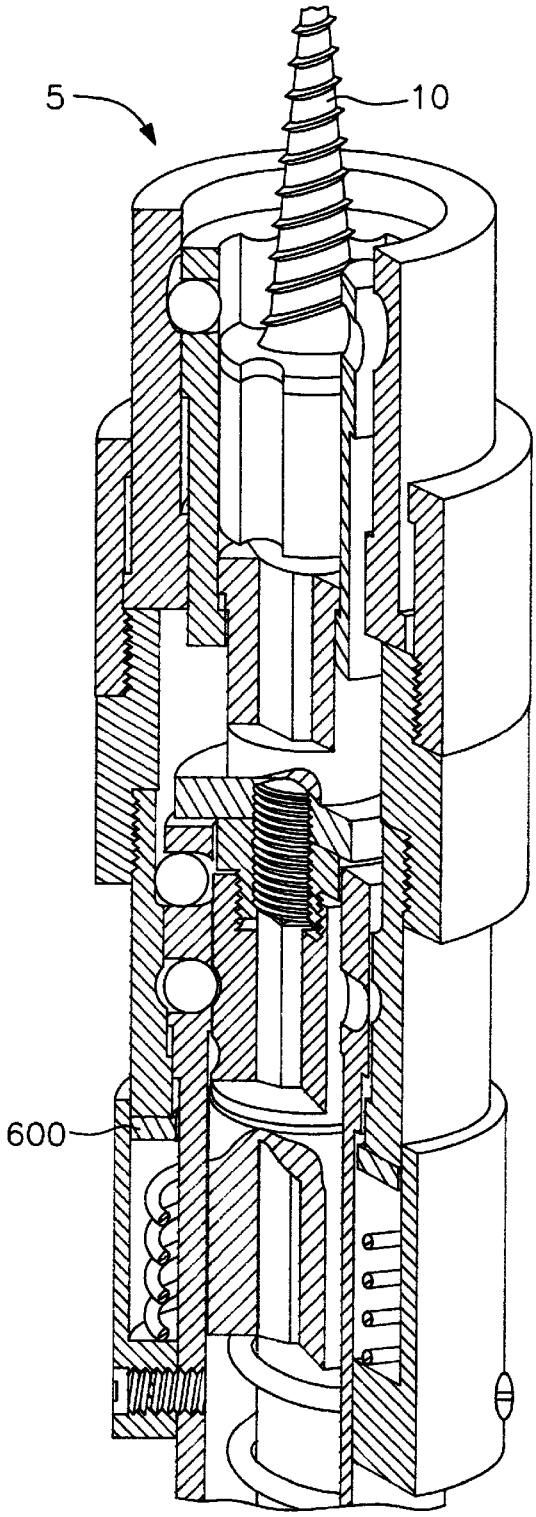
Figure 18A:
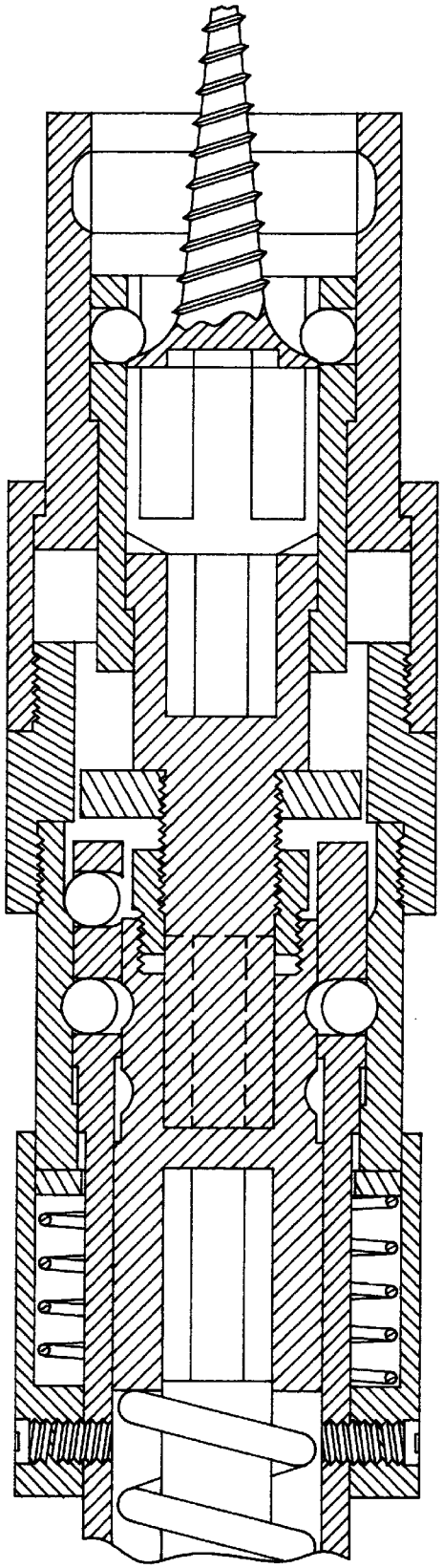
FIGS. 18(*a*) and 18(*b*) are cross sectional side and cut-away perspective views, respectively, of the apparatus in a drill position.
Figure 18B:
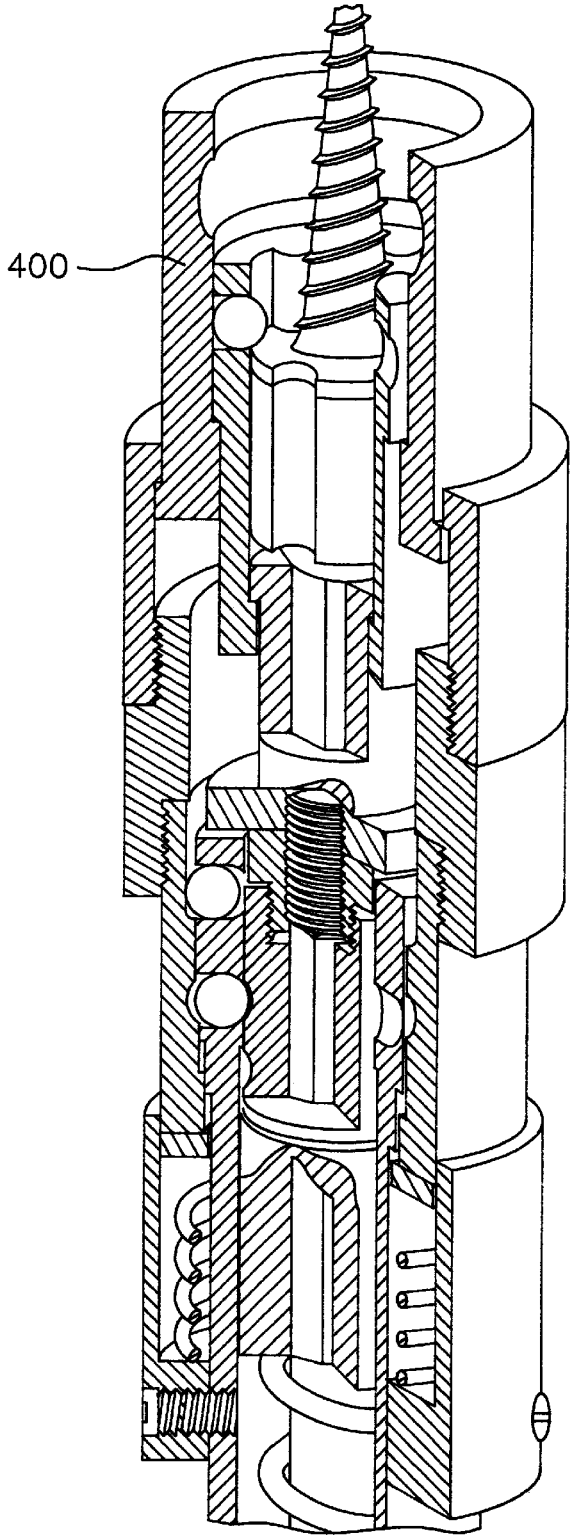
Figure 19A:
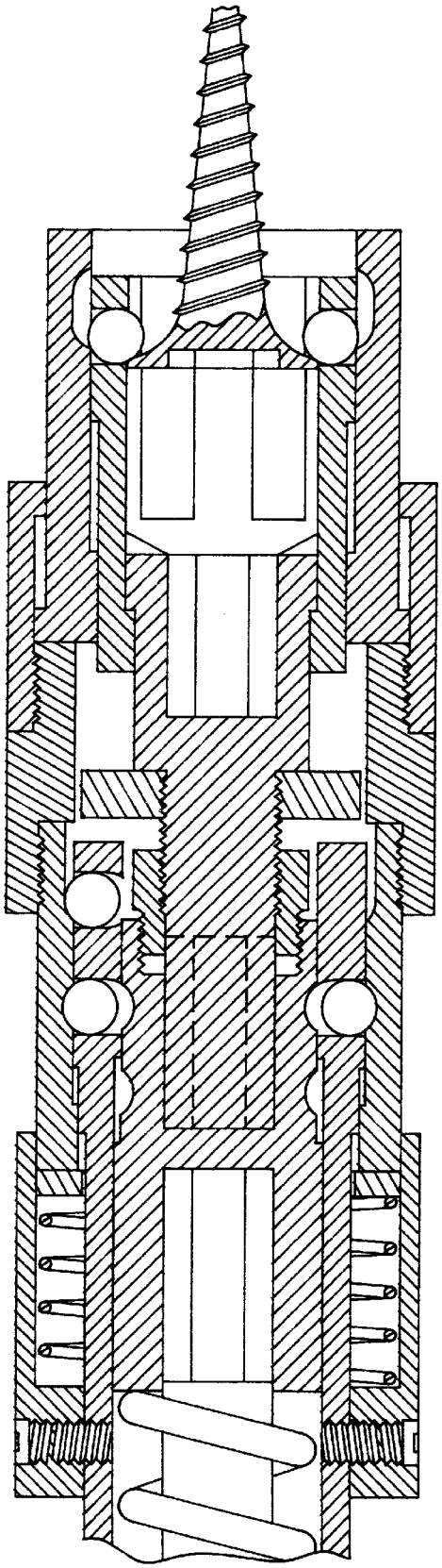
FIGS. 19(*a*) and 19(*b*) are cross sectional side and cut-away perspective views, respectively, of the apparatus in a prerelease position.
Figure 19B:
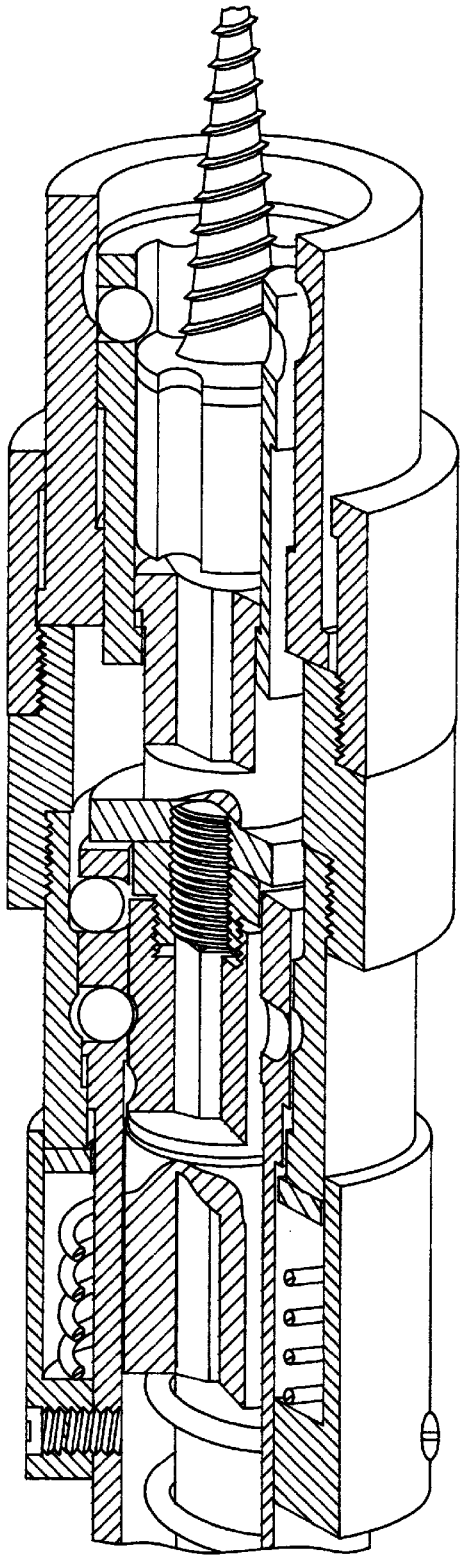
Figure 20A:
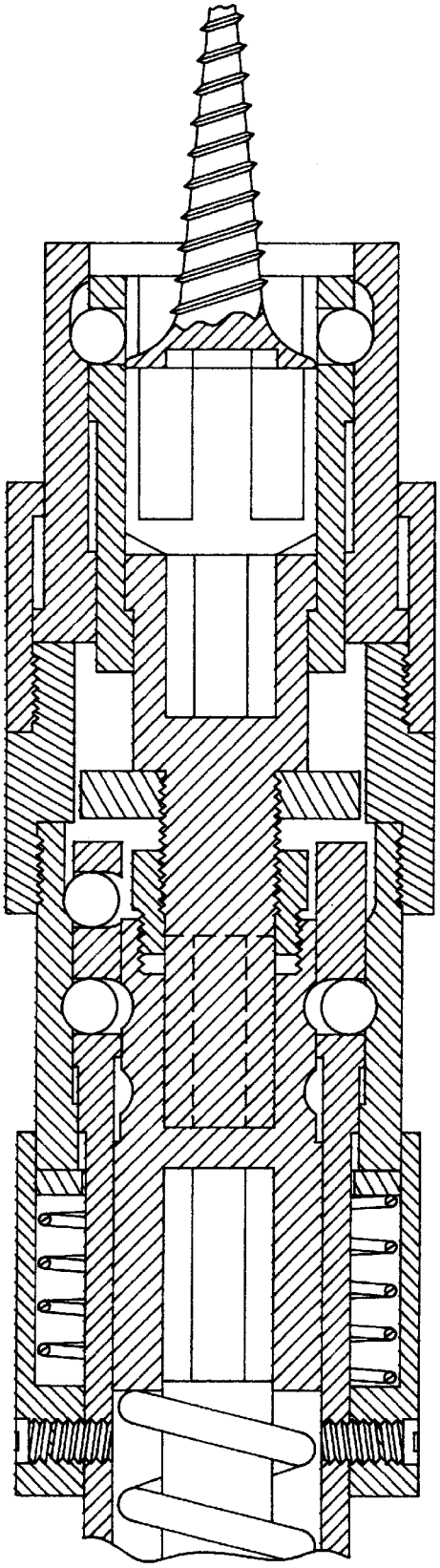
FIGS. 20(*a*) and 20(*b*) are cross sectional side and cut-away perspective views, respectively, of the apparatus in a release position.
Figure 20B:
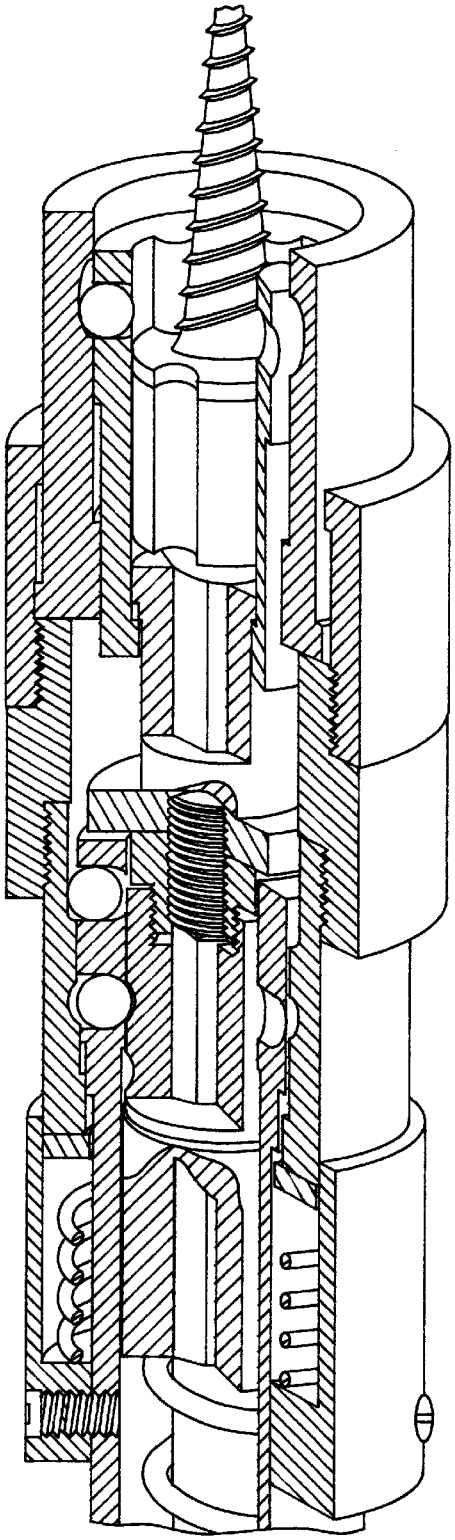
Figure 21A:
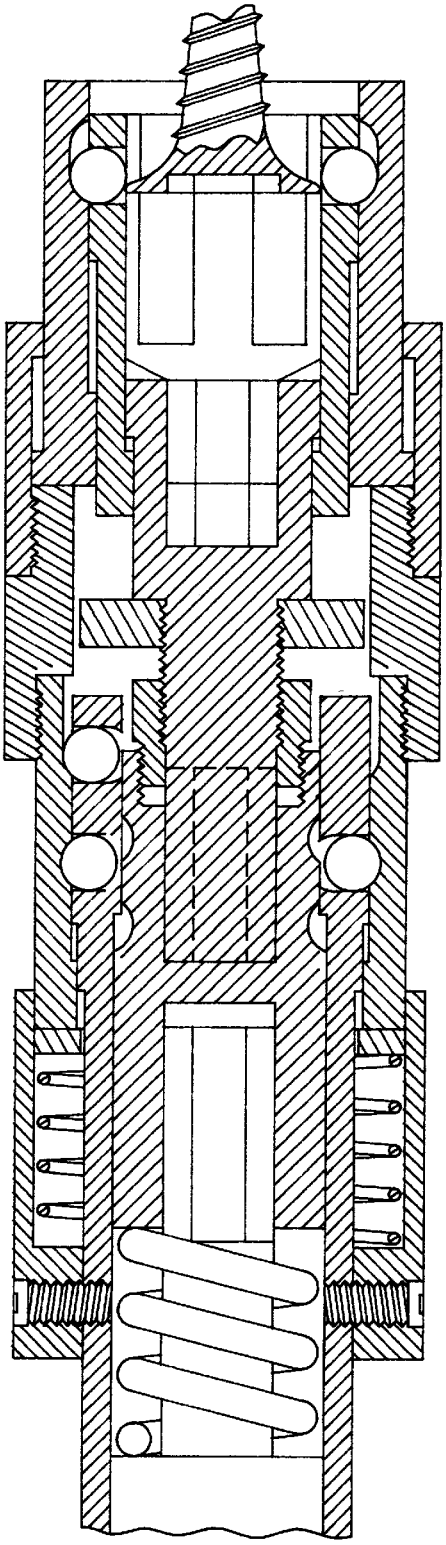
FIGS. 21(*a*), 21(*b*), 22(*a*), 22(*b*), 23(*a*) and 23(*b*) are cross sectional side and cut-away perspective views of the apparatus in different stages of a windup position.
Figure 21B:
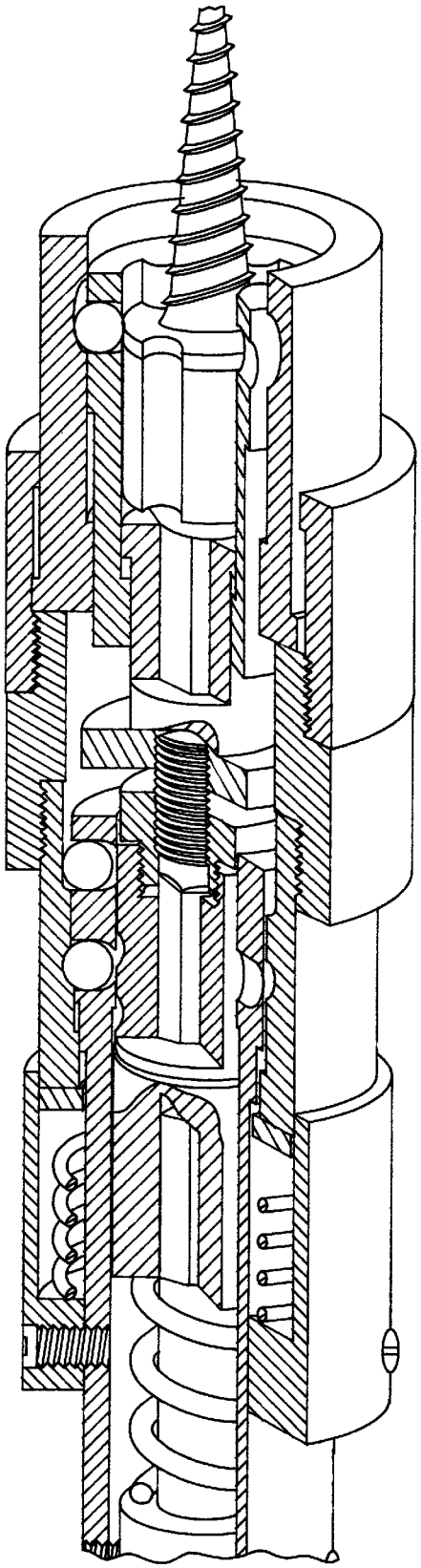
Figure 22A:
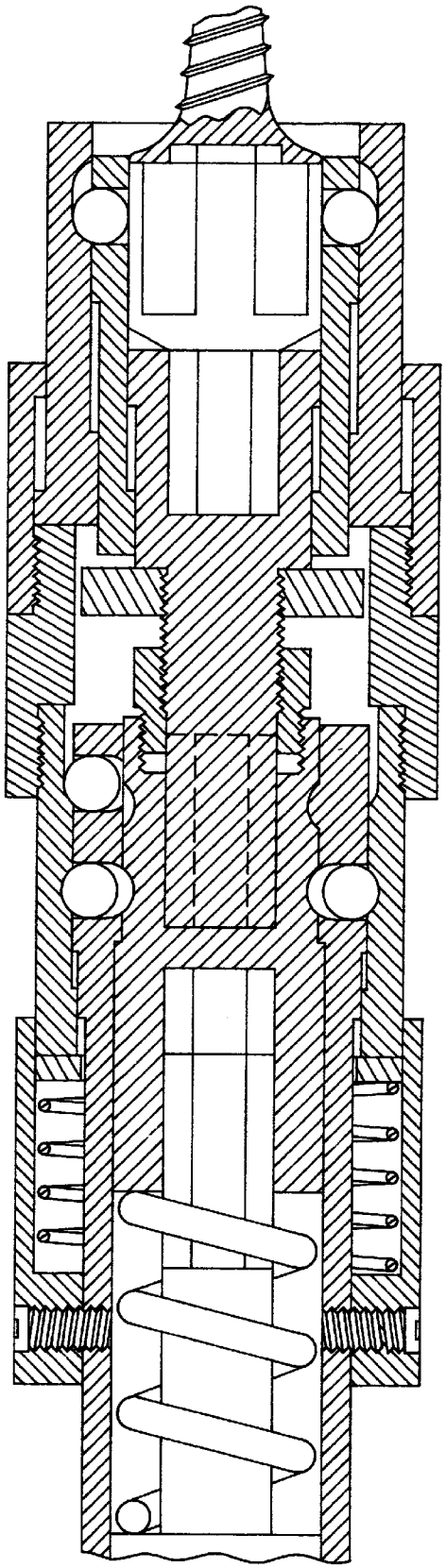
Figure 22B:
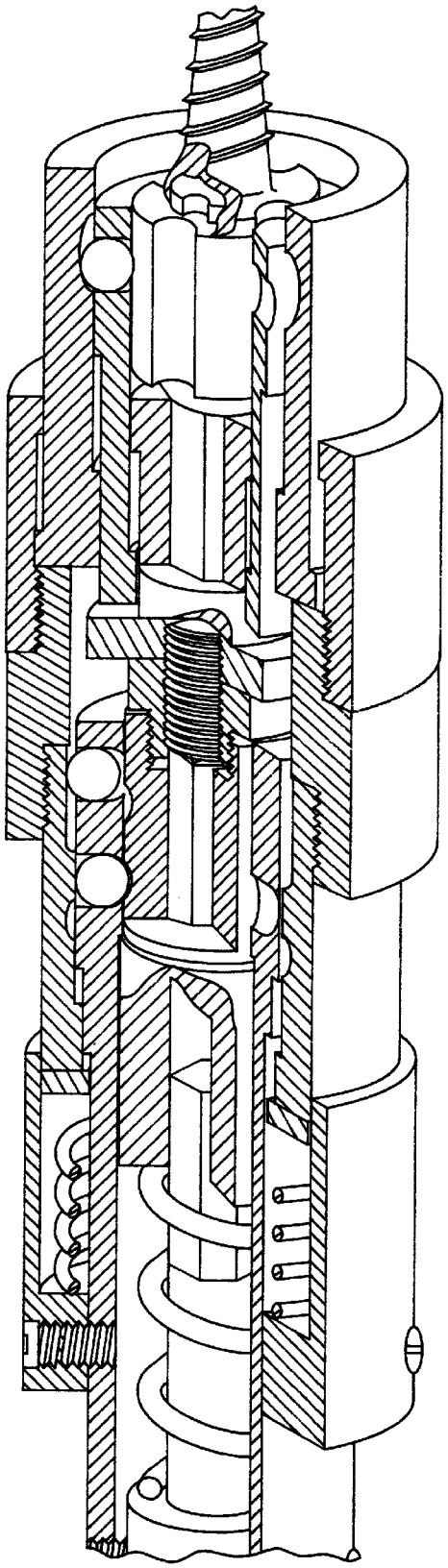
Figure 23A:
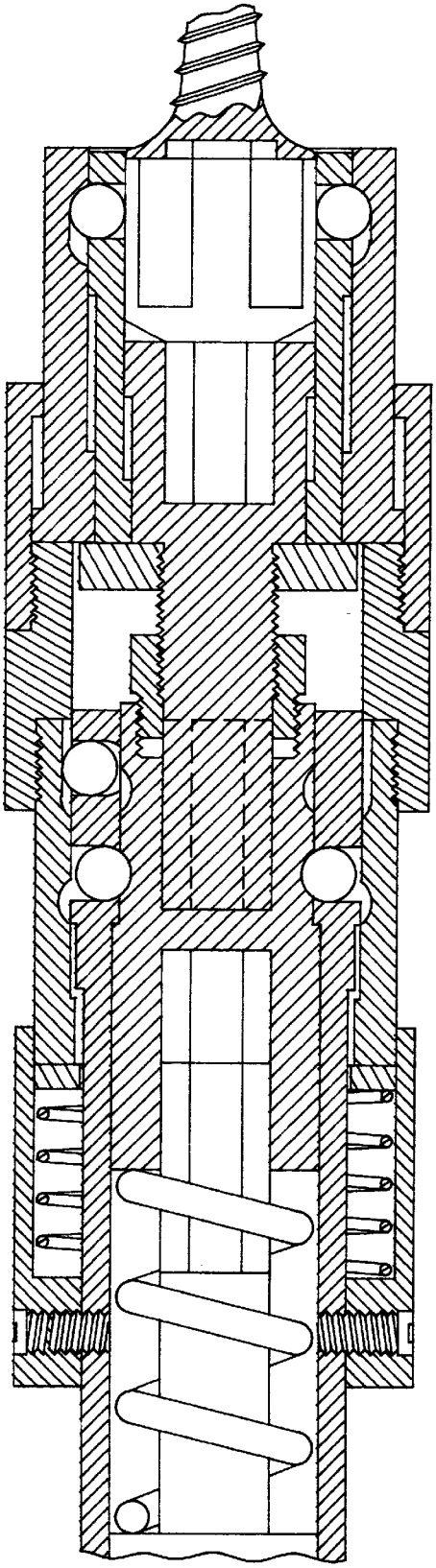
Figure 23B:
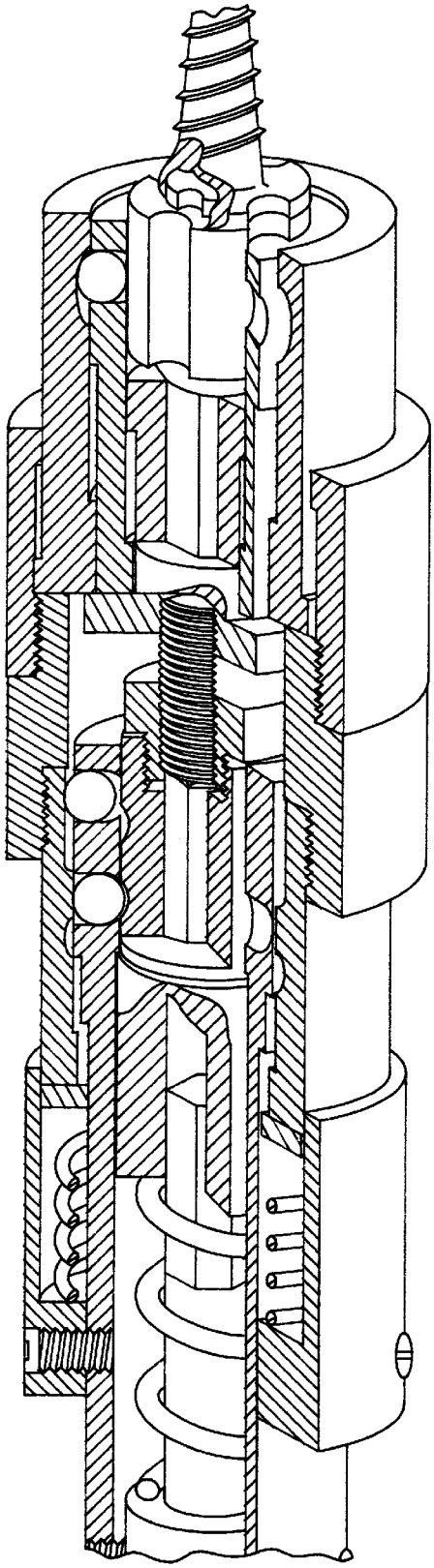

FIGS. 16–23 show the screw driving apparatus 5 fully assembled, and in one of five basic operational positions: ready position (FIGS. 16(*a*), 16(*b*)); load position (FIGS. 17(*a*), 17(*b*)); screw position (FIGS. 18(*a*), 18(*b*)); a pre-release position (FIGS. 19(*a*) and 19(*b*)); release position (FIGS. 20(*a*) and 20(*b*)); and, windup positions (FIGS. 21–23).

In general, the apparatus 5 is typically stored in the ready position and moved to the load position in order to affix the nail 10 to the apparatus 5. Once the nail 10 is placed on the apparatus 5, the apparatus is moved to the drill position, in which the nail 10 is locked to the apparatus 5. In this position, the nail is screwed to a substrate. At a certain distance from the head of the nail to the surface of the substrate, the nail will be released from the apparatus 5, the release position. The nail is further rotated in the windup position to drill the nail to the a predetermined depth within the substrate. Once screwing is complete, the apparatus 5 is removed from the nail 10 and the apparatus 5 automatically returns to the ready position.

FIGS. 16(*a*) and 16(*b*) show the apparatus in a ready position. Here, the main spring 610 presses the first stage coupler 200, and thereby also the second stage coupler 250 and screw bit 50, upward. This creates a space between the top of the drive shaft 100 and end of the lower bore 232 of the first stage coupler 200. In addition, the top of the screw bit 50 is nearly flush with the top of the secondary cylinder 350. The upper sleeve 400 is retracted so that ball 358 is pushed into trench 402 of the upper sleeve 400 by screw bit 50.

In addition, the outer spring 620 presses washer 600, as well as the lower sleeve 450, upper locking collar 500 and upper sleeve 400, upward in the embodiment of the figures. The lower ball 318 is in a neutral position within the through-hole of the main cylinder 300. In the neutral position, the lower ball 318 is not forced into rear indent 218 of the first stage coupler 200 or into channel 456 of the lower sleeve 450. Thus, the lower ball 318 does not affect motion of the lower sleeve 450 or the first stage coupler 200.

The upper ball 316, however, is not aligned with the leading indent 216 of the first stage coupler 200. Accordingly, the first stage coupler 200 forces the upper ball 316 into gutter 454 of lower sleeve 450. As the outer spring 620 forces the lower sleeve 450 upward, the upper ball 316 will reach the end of gutter 454. This prevents the outer spring 620 from advancing the lower sleeve 450 beyond ball 316.

FIGS. 17(*a*) and 17(*b*) show the apparatus in the loaded position. To load the nail 10, the nail 10 is engaged with at least the top section 52 of the screw bit 50. The notches 60 of the screw bit 50 receive the male projections 18 of the nail 10 and the female recesses 58 of the nail 10 slidably receive the male ridges 362 of the secondary cylinder 350 to prevent rotational, side-to-side and front-to-back movement of the nail 10 with respect to the secondary cylinder. The cavity 16 and projections 18 of the nail 10 are aligned with the respective top section 52 and notches 60 of the screw bit 50. When the nail 10 engages the screw bit 50, the recesses 20 of the nail 10 fall into alignment with respective grooves 58 of the screw bit 50 and the ridges 362 of the secondary cylinder 350. The ridges 362 impart a turning force to the screw bit 50 and screw 10, so that grinding of the projections 18 and screw top 52 is avoided.

Nail 10 is pressed into screw bit 50, forcing the screw bit 50 downward, together with the first and second stage coupling devices 200, 250, against the force of inner spring 610. The nail 10 can be pressed until the top of the drive shaft 100 reaches the end of the lower bore 232 of the first stage coupling device 200, as best shown in FIG. 17(*a*). The secondary cylinder 350 is retained by the cooperation of balls 358 and trench 402. Thus, the outer lip of the second stage coupler 250 contacts internal lip 360 of the secondary cylinder 350.

As the nail 10 is pressed to the screw bit 50, the projections 18 of the nail 10 engage the notches 60 of the screw bit 50. The projections 18 and notches 60 cooperate to form a firm fit that maintains nail 10 in engagement with screw bit 50. The recesses of the nail 10 engage the ridges 362 of the secondary cylinder 350 to prevent nail 10 from rotating with respect to the secondary cylinder 350.

In addition, as the nail 10 is depressed, the first stage coupler 200 will move downward until the top surface of the coupler 200 passes upper ball 316 of the main cylinder 300. As a result, the upper ball 316 is no longer forced into gutter 454, thereby releasing the lower sleeve 450 to extend further upward by force of spring 620. As best shown in FIG. 18(*a*), the lower sleeve 450 and washer 600 move upward until the inner lip 458 of the sleeve 450 engages the outer upper lip 334 of main cylinder 300, or the washer 600 engages the lower lip 336 of main cylinder 300. The lower lip 336 prevents the washer 600 from moving beyond chamber 554. In addition, and in general, the various lips, indents, grooves and channels of apparatus 5 prevent overextension of the various components of the device.

Thus, returning back to FIGS. 17(*a*) and 17(*b*), the lower sleeve 450 and the upper outer locking collar 500 move forward (or upward in the figures). Additionally, the top surface 522 of the lower member 520 of the leading collar 500 engages the upper sleeve 400. The upper sleeve 400 moves upward until the trench 402 is beyond balls 358 (FIG. 18). The upper sleeve 400 forces the balls 358 inward and against the through-hole lip, thereby locking the nail 10 to the screw bit 50. Furthermore, the recesses of nail 10 locks into the ridges of the secondary cylinder 350, projections 18 engage notches 60, so that the nail will be locked side-to-side front-to-back and upwards-to-downwards.

Furthermore, when the upper ball 316 of the main cylinder 300 is released from gutter 454, the lower balls 318 of the main cylinder 300 align with the upper indent 216 of the first stage coupler 200. As the lower sleeve 450 moves upward (as shown in FIG. 18(*a*)), the lower balls 318 are forced into the upper indents 216 of the first stage coupler 200. The lower balls 318 and upper indents 216, and the upper ball 316 and the top of the first stage coupler, cooperate to lock movement of the first stage coupler 200, as well as the second stage coupler 250, screw bit 50 and nail 10. Hence, the potential force of inner spring 610, which is at maximum compression, is stored.

Continuing on to FIGS. 18(*a*) and 18(*b*), the user pulls the upper sleeve 400 upward until the internal lip 404 of the sleeve 400 contacts the lip 356 of the secondary cylinder 350 and the external lip 406 contacts the head 512 of the upper member 510 of leading collar 500. The upper sleeve 400 further reinforces displacement of ball 358 inward to better lock the nail 10 to screw bit 50. The upper sleeve 400 also operates as a shield to prevent dirt or debris from entering and also prevents injury to a finger or other object that might otherwise become caught on the nail 10. The upper sleeve 400 further prevents objects from contacting the nail 10 that might otherwise displace the nail.

In the drilling position of FIG. 18, the nail 10 may be screwed into the substrate. The nail may be screwed manually or by use of an electric motor (such as a drill) attached to the end of the drive shaft 100. As the nail 10 progresses into the substrate, the upper sleeve 400 is pushed downward until eventually it contacts the top surface 522 of the lower member 520 of locking collar 500. The screwing action then further pushes the sleeve 400, together with upper locking collar 500, lower sleeve 450 and washer 600 downward, against the action of spring 620.

As screwing progresses, the end of the upper sleeve 400 will be in contact with the substrate receiving the screw 10. In order to prevent the sleeve 400 from grinding or otherwise marking the substrate, it is desirable that the sleeve 400 not rotate during screwing. Thus, the screw driving apparatus 5 is configured so that, during rotation of shaft 100, the first and second stage couplers 200, 250, screw bit 50 and nail 10, the primary and secondary cylinders 300, 350, and the collar 550 rotate simultaneously with shaft 100. However, the sleeve 400, 450 and the collar 500 are slidably free from rotating with shaft 100.

FIGS. 19(*a*) and 19(*b*) show the apparatus in a pre-release position. At this point, the nail 10 has been partially screwed into a substrate. The apparatus 5 is shown just prior to the gutter 454 and channel 456 of the lower sleeve 450 aligning with the upper and lower balls 316, 318, respectfully. Accordingly, the potential energy of the main inner spring 610 is still retained by the action of the lower balls 318 being locked in the upper indent 216 of the first stage coupling device 200, as well as the upper balls 316 acting against the top edge of coupler 200. Likewise, the nail 10 is still retained on screw bit 50 by balls 358.

Turning to FIGS. 20(*a*) and 20(*b*), the upper sleeve 400 is further pushed downward by the substrate as a result of the screwing action of nail 10. At this point, the balls 358 are aligned with trench 402, thereby releasing nail 10 from screw bit 50. The balls 358 are in a neutral position, and are not forced either in an inward direction or in an outward direction into trench 402. However, the recesses 20 of nail 10 remain engaged with ridges 362 of the secondary cylinder 350. Thus, the nail 10 is rotated by the transfer of power at ridges 362 and recesses 20.

Additionally, upper ball 316 of the main cylinder 300 is aligned with gutter 454 of the lower sleeve 450. Hence, upper ball 316 also enters a neutral position, and is not forced outwardly into the gutter 454 or inwardly. The lower balls 318 align with channel 456 of the lower sleeve 450, so that the lower balls 318 are also in a neutral position. This releases the potential energy of the inner spring 610. Accordingly, the first stage coupling device 200, second stage coupling device 250, screw bit 50 and nail 10 are now able to move forward under action of inner spring 610.

In FIGS. 21(*a*) and 21(*b*), the first stage coupler 200 has moved forward slightly, so that lower ball 318 is between the upper and lower indents 216, 218. In this position, the lower ball 318 is forced into channel 456, thereby locking movement of the lower sleeve 450, as well as locking collar 500 and preventing further downward movement of the upper sleeve 400. But, the first and second stage couplers, screw bit 50 and nail 10 keep moving forward under action of inner spring 610. The nail 10 also moves further into the substrate by the screwing or rotating motion.

At FIGS. 22(*a*) and 22(*b*), the first stage coupler 200 has moved further forward due to the force of inner spring 610. Lip 214 of the first stage coupling device 200 contacts the internal lip 324 of main cylinder 300, to prevent the first stage coupler 200 from moving further forward. The lower ball 318 is now aligned with the rear indent 218 of the first coupler 200. Thus, the lower ball 318 is now in a neutral position that permits the upper sleeve 400, upper locking collar 500, and lower sleeve 450 to again move downward against force of spring 620. Accordingly, the nail may be further drilled into the substrate.

When the nail 10 is beyond secondary cylinder 350, the power to turn the nail 10 no longer occurs at ridges 362 and recesses 20 (as was the case for FIGS. 18–22), and the nail 10 is rotated in a conventional manner for drivers and screws, that is, by cooperation of the top portion 52 of screw bit 50 with cavity 16 of nail 10. The apparatus 5 is desired to release nail 10 from the secondary cylinder 350 so that the secondary cylinder 350 does not grind into the substrate.

FIGS. 23(*a*) and 23(*b*) show the upper sleeve 400 having moved further downward. The trench 402 of the upper sleeve 400 is made sufficiently wide to permit the sleeve 400 to move to the present position until the balls 358 contact the top of the trench 402. Here, the top surface of the upper sleeve 400 is about 0.5 mm from the top surface of the secondary cylinder 350. The balls 358 are locked in the trench 402, so that the upper end of the trench 402 does not permit the sleeve 400 to move further downward. In addition, lower balls 318 lock into the rear indents 218 of coupler 200. Accordingly, the screw bit 50 cannot move forward or backward. However, the upper sleeve 400, leading locking collar 500 and lower sleeve 450 move downward, against force of spring 620, until the bottom of leading sleeve 400 and cylinder 350 contact the adjustment ring 280.

The front face of the screw bit protrudes slightly from the top surface of the secondary cylinder 350 and is substantially flush with the top surface of the upper sleeve 400. The upper sleeve 400 and secondary cylinder 350 may move inward until the bottoms of upper sleeve 400 and secondary cylinder 350 contact the adjustment ring 280. However, the ring 280 may be adjusted to control the depth the nail 10 is embedded within the substrate being nailed. The nail may be fully embedded, flush, or somewhat raised, with respect to the surface of the substrate.

The lower sleeve 450 moves further downward, pushing lower balls 318 into the rear indents 218 of the first coupler 200. Here, the lower balls 318 and indents 218 cooperate to prevent backward movement of the first and second couplers 200, 250 during the final rotation of the nail in a conventional manner. The drive shaft 100 may then be turned a half turn to embed the nail 10 within the substrate.

After the nailing is complete, the outer spring 620 pushes the washer 600 and lower sleeve 450 upward until the upper ball 316 meets the end of gutter 454. At this point, the lower balls 318 are aligned with the channel 456 of the lower sleeve 450. The apparatus 5 will then be in the ready position, as shown in FIGS. 16(*a*) and 16(*b*).

In FIGS. 22–23, the nail 10 is held to the screw bit 50 by the friction fit between the nail 10 and the screw bit 50. The friction fit is sufficient to maintain nail 10 to the screw bit 50, while allowing the user to remove the apparatus from the nail 10 once drilling is complete.

Figure 24:
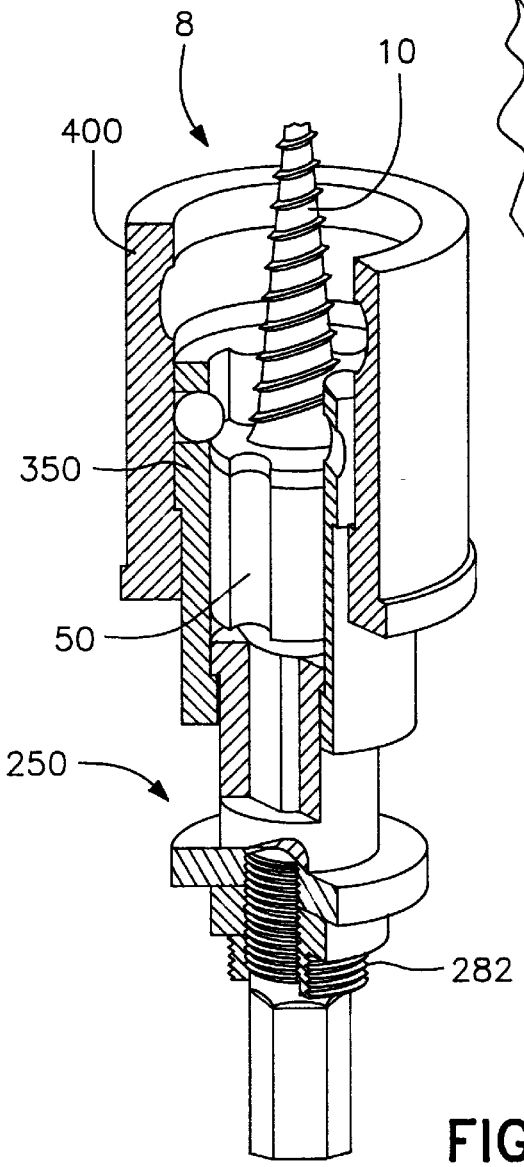
FIG. 24 is a cut-away perspective view of a detachable portion of apparatus 5.

FIG. 24 shows an alternative preferred embodiment of the apparatus 8 (same as 6) which is separated from apparatus 5 by unscrewing the leading collar 500 and the connecting plug 282. This embodiment is best suited for manual use, but may also be used with an electric drill or the like. Here, the apparatus 8 comprises screw bit 50, coupler 250, cylinder 350, and sleeve 400. The coupling device 250 forms the drive shaft of the present embodiment. The coupling device 250 has an adjustment ring 280 and a plug 282. Plug 282 allows apparatus 8 to be connected to other components of FIG. 15, but otherwise is not essential to the present embodiment.

The cylinder 350 and sleeve 400 are initially in a down position so that trench 402 aligns with balls 358. A nail 10 is placed on screw bit 50. The user then pulls up on the sleeve 400 until the balls 358 are above the head of the nail. The sleeve 400 is then extended upward, until the inner lip of the sleeve 400 contacts the outer lip of the cylinder 350. Thereby, balls 358 are locked inward, which in turn locks nail 10 to the screw bit 50. And, the nail head will be slidably locked inside the cylinder 350 by its ridges 362 which engage with the recesses of the nail head.

Figure 25:
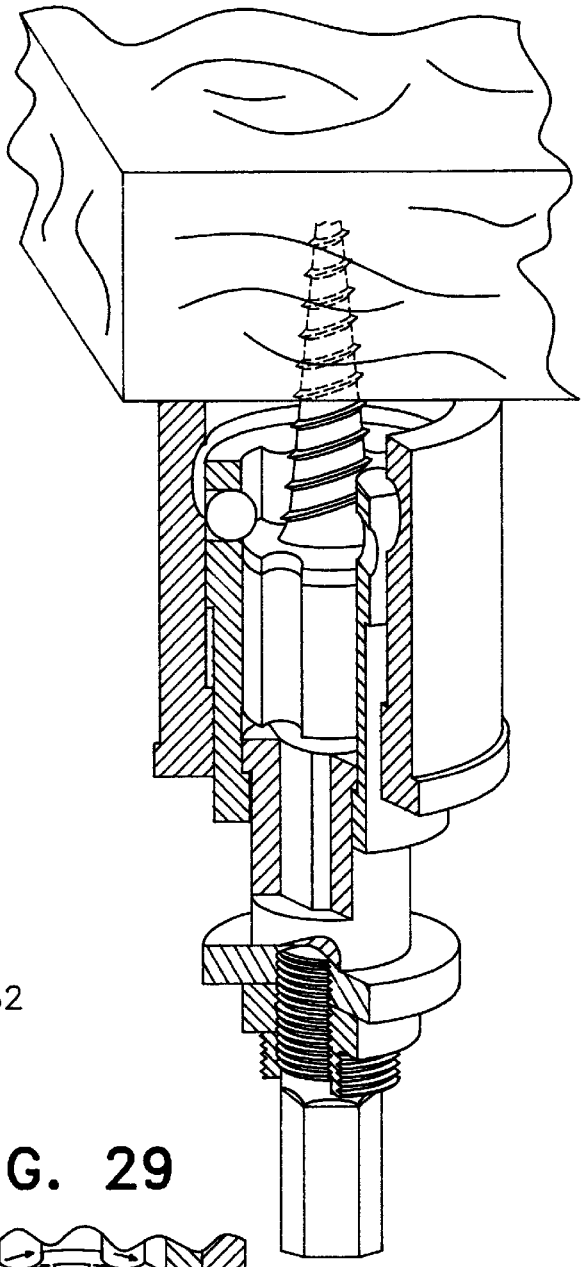
FIG. 25 is a cut-away perspective view of the detached embodiment of the invention in a drill position.
Figure 28:
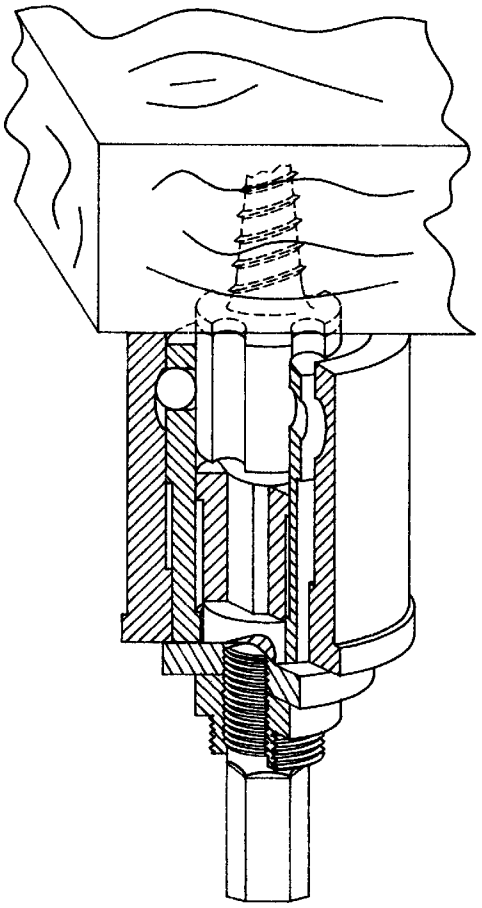
Figure 27A:
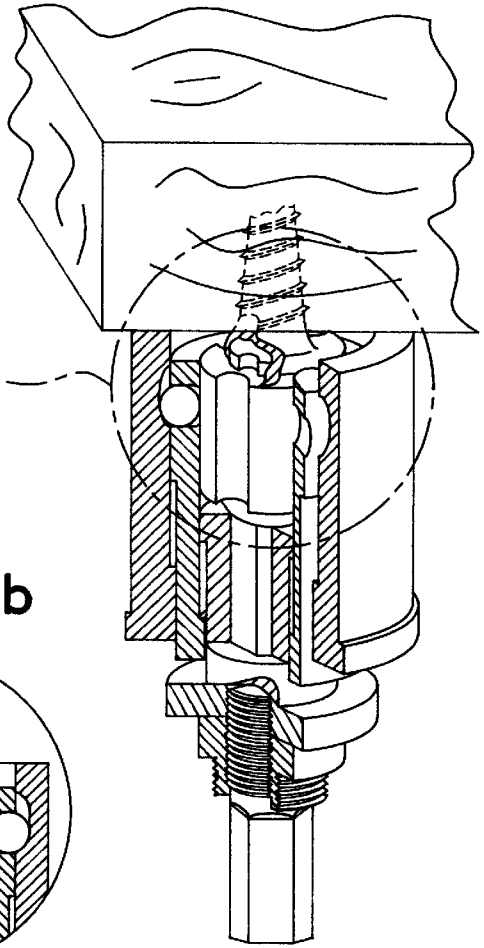
Figure 27B:
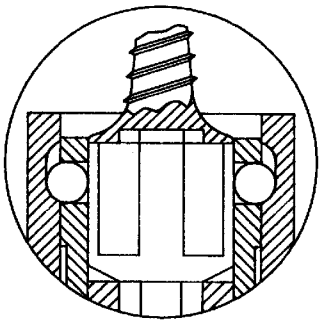
Figure 26:
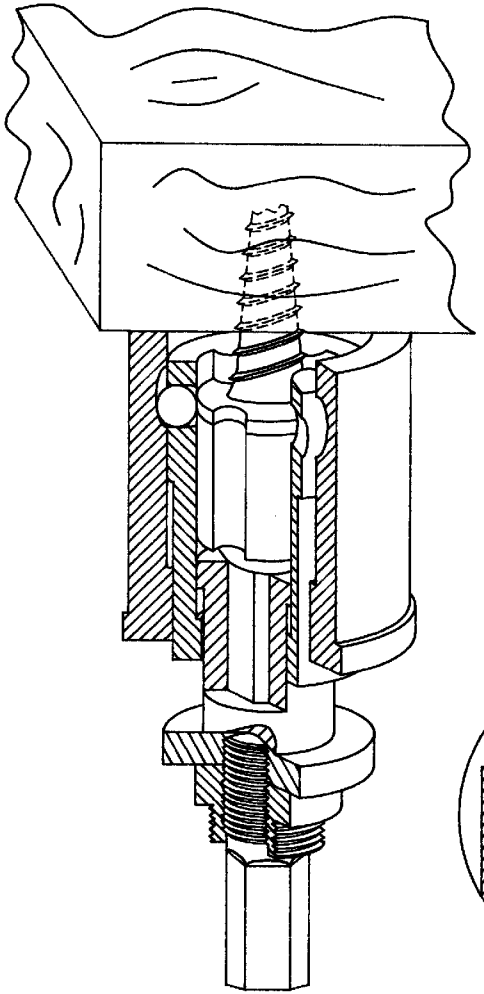
FIG. 26 is a cut-away perspective view of the detached embodiment of the invention in a release position.

As shown in FIG. 25, the user then screws nail 10 into a substrate. As screwing progresses, the sleeve 400 retreats back onto the cylinder 350. In FIG. 26, the ball 358 enters trench 402, unlocking the nail 10 from the screw bit 50. The nail 10 is still locked inside the cylinder 350 by ridges 362 and recesses 20 of the nail. Screwing continues until, as shown in FIG. 27, the nail is locked inside the cylinder 350 by the ridges and recesses of the nail. Screwing stops at FIG. 28 when the adjustment ring 280 contacts the bottom of sleeve 400 and cylinder 350. However, screwing is also stopped when the ball 358 reaches the top of the trench 402, so that the adjustment plug and ring need not be provided.

Further to the preferred embodiment of FIGS. 16–23, the leading locking collar 500 is preferably formed as an upper and lower member 510, 520 that are screwed together. This makes for easier assembly and disassembly of the apparatus 5. In addition, the user may unscrew the upper and lower members 510, 520 in order to gain easy access to the adjusting plug 282 and ring 280, without having to disassemble the entire apparatus. However, the lower member 520 of locking collar 500 and lower sleeve 450 may be fashioned as a single component and the first and second coupling devices 200, 250 may be formed as a single component and the adjustment ring and plug may be eliminated.

Also in the preferred embodiment, there are four balls 358, a single upper ball 316 and four rear balls 318, as well as four ridges 362. It is recognized, however, that any suitable number of balls and ridges may be used and is not be limited by the preferred embodiment.

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

We claim:

1. A screw driving apparatus for use with a screw bit capable of receiving a screw having a head, comprising:

a drive shaft having a ring;

a first coupling member having a top surface, a first bore at a first end slidably receiving said drive shaft and a second bore at a second end, a first indent and a second indent formed in the second end of said first coupling member;

a second coupling member forming a rod at a first end that is slidably received by the second bore of said first coupling member and a bore at a second end for receiving the screw bit;

a first cylinder slidably receiving said drive shaft, said first cylinder having a first end connected to the ring of said drive shaft and a second end with first and second through-holes;

a second cylinder slidably mounted about said second coupling member and having through-holes;

a first spring positioned about said drive shaft, the spring having a first end positioned against the ring of said drive shaft and a second end positioned against said first coupling member;

a first collar connected to the first cylinder and forming a space therebetween, said first collar having a ledge;

a second spring located within the space formed between said first collar and said first cylinder and positioned against the ledge of said first collar;

a washer slidably mounted about said first cylinder within the space formed between the first cylinder and the first collar, said washer positioned against said second spring;

a first sleeve slidably mounted about said first cylinder adjacent said washer and having a channel and a gutter;

a second sleeve slidably mounted about said second cylinder adjacent said second collar and having a trench;

a second collar mounted about said second sleeve and connected to said first sleeve;

a first ball mounted in the first through-hole of said first cylinder for operatively engaging the top surface of said first coupling member and the gutter of said first sleeve;

a second ball mounted in the second through-hole of said first cylinder for operatively engaging the first and second indents of said first coupling member and the channel of said first sleeve; and, a third ball mounted in the through-hole of said second cylinder for operatively engaging the head of the screw and the trench of said second sleeve.

2. The apparatus of claim 1, further comprising at least one column extending longitudinally along an inner surface of said second cylinder.

3. The apparatus of claim 1, wherein each of the through-holes have lips positioned at an internal side of the respective through-hole that prevents the respective first, second or third ball from dislodging from the through-hole.

4. The apparatus of claim 1, further comprising an adjustment ring adjustably mounted to said second coupling member.

5. The apparatus of claim 1, further comprising elongated ridges located at an inner surface of said second cylinder parallel to a longitudinal axis of said second cylinder, the ridges engaging recesses formed along an outer circumference of the head of the screw for imparting a rotating force thereto.

6. A screw driving apparatus for use with a screw bit capable of receiving a screw having a head, comprising:

a coupling member having a bore at one end for slidably receiving the screw bit and forming a drive shaft at an opposite end, a cylinder mounted about said coupling member and the screw bit, said cylinder having a through-hole;

a sleeve mounted about said cylinder having a trench; and, a ball disposed in the through-hole of said cylinder for operatively engaging the head of the screw and the trench of said sleeve.

7. The apparatus of claim 6, further comprising at least one column extending longitudinally along an inner surface of said cylinder.

8. The apparatus of claim 6, wherein the through-hole has lips positioned at an internal side of the through-hole that prevent the ball from dislodging from the through-hole.

9. The apparatus of claim 6, further comprising an adjustment ring adjustably mounted to said coupling member.

10. The apparatus of claim 6, further comprising elongated ridges located at an inner surface of said second cylinder parallel to a longitudinal axis of said second cylinder, the ridges engaging recesses formed along an outer circumference of the head of the screw for imparting a rotating force thereto.

11. A screw driving apparatus for use with a screw bit capable of receiving a screw having a head, comprising:

a drive shaft having a ring;

a coupling member having a surface, a first bore at a first end slidably receiving said drive shaft, a first indent and a second indent, and a second bore at a second end for receiving the screw bit;

a first cylinder slidably receiving said drive shaft, said first cylinder having a first end connected to the ring of said drive shaft and a second end with a first through-hole and a second through-hole;

a second cylinder slidably mounted about said coupling member and having a through-hole;

a first spring positioned about said drive shaft, the spring having a first end positioned against the ring of said drive shaft and a second end positioned against said coupling member;

a collar connected to the first cylinder and forming a space therebetween, said collar having a ledge, said collar mounted about the first cylinder;

a second spring located within the space formed between said collar and said first cylinder and positioned against the ledge of said collar;

a washer slidably mounted about said first cylinder within the space formed between the first cylinder and the collar, said washer positioned against said second spring;

a first sleeve slidably mounted about said first cylinder adjacent said washer and having a channel and a gutter;

a second sleeve slidably mounted about said second cylinder adjacent said collar and having a trench;

a first ball mounted in the first through-hole of said first cylinder for operatively engaging the surface of said coupling member and the gutter of said first sleeve;

a second ball mounted in the second through-hole of said first cylinder for operatively engaging the first and second indents of said coupling member and the channel of said first sleeve; and, a third ball mounted in the through-hole of said second cylinder for operatively engaging the head of the screw and the trench of said second sleeve.

12. The apparatus of claim 11, further comprising at least one column extending longitudinally along an inner surface of said second cylinder.

13. The apparatus of claim 11, wherein each of the through-holes have lips positioned at an internal side of the through-hole that prevent the ball from dislodging from the through-hole.

14. The apparatus of claim 11, further comprising an adjustment ring adjustably mounted to said coupling member.

15. The apparatus of claim 11, further comprising elongated ridges located at an inner surface of said second cylinder parallel to a longitudinal axis of said second cylinder, the ridges engaging recesses formed along an outer circumference of the head of the screw for imparting a rotating force thereto.

16. A screw driving apparatus comprising:

a screw bit; and a cylinder having an inner surface with elongated ridges slidably receiving recesses of a screw head formed along an outer circumference of the head of a screw and imparting a rotating force thereto.

* * * * *